US009005864B2

(12) United States Patent
Satoh et al.

(10) Patent No.: US 9,005,864 B2
(45) Date of Patent: Apr. 14, 2015

(54) TONER, TWO-COMPONENT DEVELOPER AND IMAGE FORMING APPARATUS

(71) Applicants: Syouko Satoh, Miyagi (JP); Tsuneyasu Nagatomo, Shizuoka (JP); Satoshi Kojima, Shizuoka (JP); Osamu Uchinokura, Shizuoka (JP); Junichi Awamura, Shizuoka (JP); Daisuke Ito, Kanagawa (JP); Satoshi Ogawa, Nara (JP); Kiwako Hirohara, Miyagi (JP); Takahiro Honda, Shizuoka (JP); Daisuke Inoue, Shizuoka (JP)

(72) Inventors: Syouko Satoh, Miyagi (JP); Tsuneyasu Nagatomo, Shizuoka (JP); Satoshi Kojima, Shizuoka (JP); Osamu Uchinokura, Shizuoka (JP); Junichi Awamura, Shizuoka (JP); Daisuke Ito, Kanagawa (JP); Satoshi Ogawa, Nara (JP); Kiwako Hirohara, Miyagi (JP); Takahiro Honda, Shizuoka (JP); Daisuke Inoue, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 60 days.

(21) Appl. No.: 13/790,434

(22) Filed: Mar. 8, 2013

(65) Prior Publication Data

US 2013/0244155 A1 Sep. 19, 2013

(30) Foreign Application Priority Data

Mar. 14, 2012 (JP) ..... 2012-057367

(51) Int. Cl.
*G03G 9/00* (2006.01)
*G03G 9/08* (2006.01)
*G03G 9/097* (2006.01)

(52) U.S. Cl.
CPC ..... *G03G 9/0827* (2013.01); *G03G 9/0819* (2013.01); *G03G 9/0821* (2013.01); *G03G 9/09708* (2013.01); *G03G 9/09716* (2013.01); *G03G 9/09725* (2013.01)

(58) Field of Classification Search
CPC ..... G03G 9/0827; G03G 9/0825
USPC ..... 430/105, 123.51, 108.7; 399/252
See application file for complete search history.

(56) References Cited

U.S. PATENT DOCUMENTS

| | | | | |
|---|---|---|---|---|
| 6,077,635 | A * | 6/2000 | Okado et al. | 430/45.54 |
| 2006/0275686 | A1* | 12/2006 | Kadota et al. | 430/108.1 |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1 | 9/2011 | Sugimoto et al. | |
| 2011/0262853 | A1 | 10/2011 | Watanabe et al. | |
| 2011/0294058 | A1 | 12/2011 | Shiba et al. | |
| 2011/0305986 | A1 | 12/2011 | Ogawa et al. | |
| 2011/0318053 | A1 | 12/2011 | Yamashita et al. | |
| 2012/0021347 | A1 | 1/2012 | Shimota et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0122027 | A1 | 5/2012 | Watanabe et al. | |
| 2012/0219896 | A1 | 8/2012 | Asahina et al. | |
| 2012/0237869 | A1 | 9/2012 | Chiba et al. | |
| 2012/0237870 | A1 | 9/2012 | Watanabe et al. | |
| 2012/0264043 | A1 | 10/2012 | Watanabe et al. | |

FOREIGN PATENT DOCUMENTS

| | | |
|---|---|---|
| JP | 11-174731 | 7/1999 |
| JP | 2005-173480 | 6/2005 |
| JP | 2006-267950 | 10/2006 |
| JP | 2010-128216 | 6/2010 |
| JP | 2010-243664 | 10/2010 |

* cited by examiner

*Primary Examiner* — Thorl Chea
(74) *Attorney, Agent, or Firm* — Oblon, McClelland, Maier & Neustadt, L.L.P.

(57) ABSTRACT

A toner including: toner base particles; and an external additive, the toner base particles each comprising a binder resin and a colorant, wherein the external additive comprises non-spherical particles and spherical particles, wherein the non-spherical particles are each a secondary particle in which spherical primary particles are coalesced together, and wherein the non-spherical particles and the spherical particles in the external additive satisfy a relationship expressed by the following formula (1):

$$3Ca(\%) < Cb(\%) \qquad \text{Formula (1)}$$

where Ca is greater than 10% but smaller than 20% and Cb is greater than 40% but smaller than 70%, and Ca and Cb are values given by:

$$Ca = \frac{\text{(an amount of the non-spherical particles (\% by mass)/100)} \times \text{(a projected area of the non-spherical particles (cm}^2\text{/g))}}{\text{(an amount of the toner base particles (\% by mass)/100)} \times \text{(a surface area of the toner base particles (cm}^2\text{/g))}} \times 100$$

$$Cb = \frac{\text{(an amount of the spherical particles (\% by mass)/100)} \times \text{(a projected area of the spherical particles (cm}^2\text{/g))}}{\text{(an amount of the toner base particles (\% by mass)/100)} \times \text{(a surface area of the toner base particles (cm}^2\text{/g))}} \times 100$$

7 Claims, 6 Drawing Sheets

TONER, TWO-COMPONENT DEVELOPER AND IMAGE FORMING APPARATUS

BACKGROUND OF THE INVENTION

1. Field of the Invention

The present invention relates to a toner, a two-component developer containing the toner, and an image forming apparatus using the toner.

2. Description of the Related Art

In recent years, image forming apparatuses have been required to provide a higher quality image, and development has been made on a toner excellent in, for example, heat resistance storageability, transferability, flowability, filming property and chargeability.

In order to improve a toner in heat resistance storageability, a toner having a core-shell structure is proposed which has, on the toner surface, a shell layer containing a resin different from a binder resin (see, for example, Japanese Patent Application Laid-Open (JP-A) No. 2006-267950). In this proposal, however, a pigment is not successfully dispersed in the shell layer and localized in the surface. As a result, this toner is poor in image quality due to its poor transferability and flowability.

In order to improve the above toner in transferability and flowability, there is proposed a toner to which an external additive containing inorganic particles has been added (see, for example, JP-A Nos. 2005-173480 and 2010-128216). According to these proposals, the external additive acts as a spacer on the toner surface, preventing adhesion between toner particles and formation of aggregates of toner particles during transportation. As a result, the toner is improved in transferability and flowability, achieving reduction of abnormal images resulting from degradation of the toner. In these proposals, however, the inorganic particles are excessively added to the toner and thus are easily exfoliated. The exfoliated inorganic particles accelerate abrasion of a cleaning blade and cause filming, raising a problem that abnormal images are formed due to impaired chargeability.

In order to improve the above toner in filming property and chargeability, there is proposed a toner to which silica having a relatively broad particle size distribution have been added as an external additive (see, for example, JP-A Nos. 11-174731 and 2010-243664). According to these proposals, an external additive having a relatively broad particle size distribution can provide a toner with a wide range of chargeability depending on the particle size distribution of the toner. In terms of an ability to impart chargeability to the toner, the silica is superior to alumina. The silica is not limited to silica obtained by a sol-gel method (i.e., sol-gel silica), and use of dry silica is recommended since the dry silica can provide a toner with a wide range of chargeability depending on the particle size distribution of the toner. The toners according to these proposals, however, use the dry silica only, and involve a problem of being poor in heat resistance storageability. When the toner is made to have a sharp particle size distribution, the external additive having a broad particle size distribution does not have to be used. Even an external additive having a sharp particle size distribution can provide uniformly chargeable toner particles. The dry silica has a non-spherical shape and contacts with each toner particle at a plurality of contact points. Thus, the dry silica is more difficult to roll on the toner than a spherical silica does thereon, so that the toner tends to be impaired in flowability.

Therefore, at present, strong demand has arisen for rapid development of a toner that is satisfactory in all of heat resistance storageability, transferability, flowability, filming property and chargeability as well as is excellent in image quality.

SUMMARY OF THE INVENTION

The present invention has been made under such circumstances, and aims to solve the above problems pertinent in the art and achieve an object of providing a toner that is satisfactory in all of heat resistance storageability, transferability, flowability, filming property and chargeability as well as is excellent in image quality.

The present invention is based on the above finding obtained by the present inventors, and means for solving the above problems are as follows.

That is, a toner of the present invention contains: toner base particles; and an external additive, the toner base particles each containing at least a binder resin and a colorant, wherein the external additive contains at least non-spherical particles and spherical particles, the non-spherical particles are secondary particles in which spherical primary particles are coalesced together, and the non-spherical particles and the spherical particles in the external additive satisfy a relationship expressed by the following formula (1):

$$3Ca(\%)<Cb(\%) \qquad \text{Formula (1)}$$

where Ca is greater than 10% but smaller than 20% and Cb is greater than 40% but smaller than 70%, and Ca and Cb are values given by:

$$Ca = \frac{\text{(an amount of the non-spherical particles (\% by mass)/100)} \times \text{(a projected area of the non-spherical particles (cm}^2\text{/g))}}{\text{(an amount of the toner base particles (\% by mass)/100)} \times \text{(a surface area of the toner base particles (cm}^2\text{/g))}} \times 100$$

$$Cb = \frac{\text{(an amount of the spherical particles (\% by mass)/100)} \times \text{(a projected area of the spherical particles (cm}^2\text{/g))}}{\text{(an amount of the toner base particles (\% by mass)/100)} \times \text{(a surface area of the toner base particles (cm}^2\text{/g))}} \times 100$$

where the surface area of the toner base particles is a value given by: 6/(an average particle diameter of the toner×a specific gravity of the toner);

the projected area of the non-spherical particles is a value given by: 3/(2×an average particle diameter of the non-spherical particles×a specific gravity of the non-spherical particles); and the projected area of the spherical particles is a value given by: 3/(2×an average particle diameter of the spherical particles×a specific gravity of the spherical particles).

The present invention can solve the above problems pertinent in the art and provide a toner that is satisfactory in all of heat resistance storageability, transferability, flowability, filming property and chargeability as well as is excellent in image quality.

DETAILED DESCRIPTION OF THE INVENTION (Toner)

Figure 1:
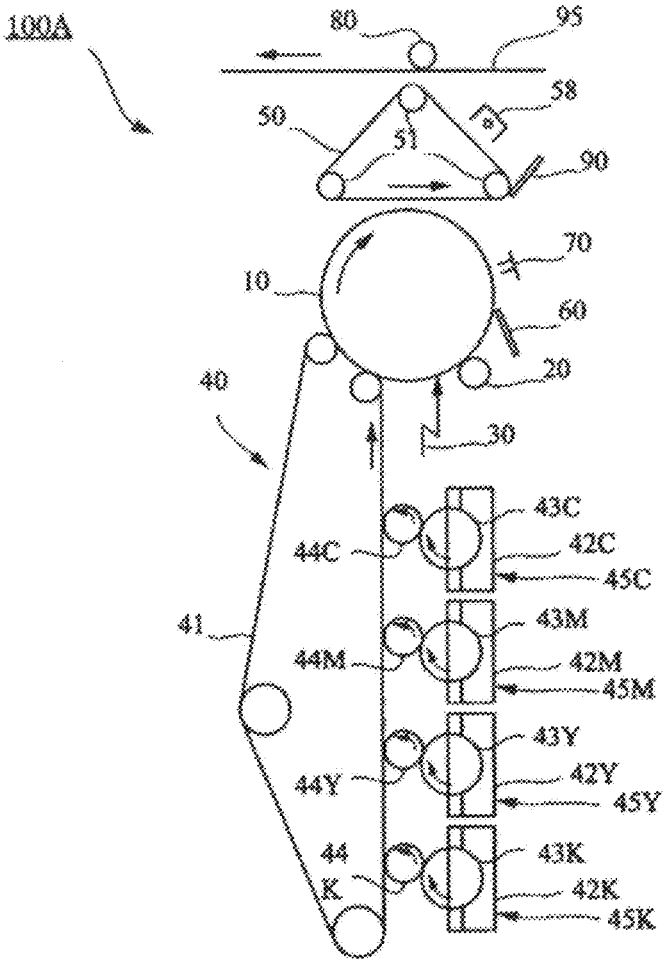
FIG. 1 is an explanatory, schematic view of an example of an image forming apparatus of the present invention.

A toner of the present invention contains at least toner base particles and an external additive; and, if necessary, further contains other ingredients.

<External Additive>

The external additive contains at least non-spherical particles and spherical particles.

The non-spherical particles are secondary particles in which spherical primary particles are coalesced together.

The non-spherical particles and the spherical particles satisfy a relationship expressed by the following formula (1):

$$3Ca(\%)<Cb(\%) \qquad \text{Formula (1)}$$

where Ca is greater than 10% but smaller than 20% and Cb is greater than 40% but smaller than 70%, and Ca and Cb are values given by:

$$Ca = \frac{\text{(an amount of the non-spherical particles (\% by mass)/100)} \times \text{(a projected area of the non-spherical particles (cm}^2\text{/g))}}{\text{(an amount of the toner base particles (\% by mass)/100)} \times \text{(a surface area of the toner base particles (cm}^2\text{/g))}} \times 100$$

$$Cb = \frac{\text{(an amount of the spherical particles (\% by mass)/100)} \times \text{(a projected area of the spherical particles (cm}^2\text{/g))}}{\text{(an amount of the toner base particles (\% by mass)/100)} \times \text{(a surface area of the toner base particles (cm}^2\text{/g))}} \times 100$$

where the surface area of the toner base particles is a value given by: 6/(an average particle diameter of the toner×a specific gravity of the toner);

the projected area of the non-spherical particles is a value given by: 3/(2×an average particle diameter of the non-spherical particles×a specific gravity of the non-spherical particles); and the projected area of the spherical particles is a value given by: 3/(2×an average particle diameter of the spherical particles×a specific gravity of the spherical particles).

The present inventors conducted extensive studies to solve the above object and have found that a toner containing: toner base particles containing at least a binder resin and a colorant; and an external additive containing at least non-spherical particles and spherical particles where the external additive satisfies specific parameters is satisfactory in all of heat resistance storageability, transferability, flowability, filming property and chargeability as well as is excellent in image quality. The present invention has been accomplished on the basis of the finding.

<<Spherical Particles>>

The spherical particles are not particularly limited and may be appropriately selected depending on the intended purpose so long as they are particles to be added to toner particles for providing the toner particles with flowability, developability and chargeability. Examples thereof include organic particles and inorganic particles such as silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These may be used alone or in combination. Among them, silica (dry silica and wet silica) is preferred, with dry silica being more preferred. Particularly preferably, titanium oxide and dry silica are used in combination. The spherical particles can provide toner particles with flowability and chargeability. Then, providing toner particles with flowability can reduce stress which toner particles receive when conveyed in an apparatus and stirred with carrier particles.

The average particle diameter of the spherical particles is not particularly limited and may be appropriately selected depending on the intended purpose, but is preferably 10 nm to 35 nm, more preferably 15 nm to 30 nm, particularly preferably 20 nm to 30 nm. When the average particle diameter is less than 10 nm, the spherical particles easily aggregate together, making it difficult to uniformly cover each toner particle. As a result, the contact area between toner particles increases, so that the aggregates are easily formed. When it is more than 35 nm, it may be difficult to provide toner particles with flowability.

The average particle diameter of the spherical particles is measured by determining an average of particle diameters of the spherical particles within a field of vision under a field emission type scanning electron microscope (FE-SEM, acceleration voltage: 5 kV to 8 kV, observed magnification: 8,000 to 10,000). Here, the number of the spherical particles measured is 100 or more.

The sphericity of the spherical particles is not particularly limited and may be appropriately selected depending on the intended purpose. It is preferably 0.8 to 1.0 since providing toner particles with flowability can reduce stress which toner particles receive when conveyed in an apparatus and stirred with carrier particles.

<<Non-Spherical Particles>>

As the non-spherical particles, particles having relatively large particle diameters are used. The non-spherical particles function as a spacer to prevent adhesion between toner particles. In addition, the non-spherical particles prevent degradation of toner particles since they are not susceptible to degradation due to external factors and thus they are hardly embedded.

The non-spherical particles are not particularly limited and may be appropriately selected depending on the intended purpose so long as they are secondary particles in which spherical primary particles are coalesced together. Note that, the "secondary particles" may be referred to as "coalesced particles." Also, once the "primary particles" are coalesced together, the "primary particles" are not separated from each other.

—Primary Particles—

The primary particles are not particularly limited and may be appropriately selected depending on the intended purpose. For example, the above spherical particles may be used as the primary particles. Silica is preferably used as the primary particles since it can provide toner base particles with flowability, developability and chargeability.

The average particle diameter of the primary particles not particularly limited and may be appropriately selected depending on the intended purpose. It is preferably 25 nm to 100 nm since the non-spherical particles successfully function as a spacer.

Figure 5:
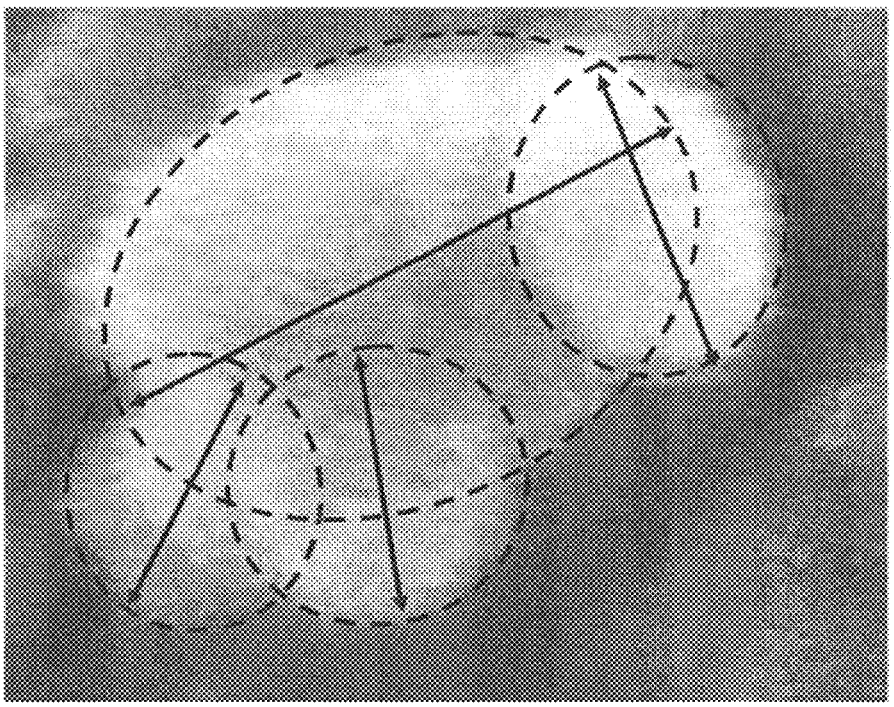
FIG. 5 is a photograph of an example of a toner of the present invention.

The average particle diameter of the primary particles is measured as follows. Specifically, the primary particles are dispersed in an appropriate solvent (e.g., THF). The resultant dispersion liquid is subjected to solvent removal to dryness on a substrate to thereby obtain a measurement sample. The measurement sample is observed under a field emission type scanning electron microscope (FE-SEM, acceleration voltage: 5 kV to 8 kV, observed magnification: 8,000 to 10,000), and measured for an average of the longest particle diameters of the primary particles aggregated. FIG. 5 illustrates a specific example where four primary particles aggregate together and each arrow indicates the longest particle diameter of each primary particle. Here, the number of the primary particles measured is 100 or more.

—Secondary Particles—

The secondary particles are not particularly limited and may be appropriately selected depending on the intended purpose. They are preferably particles in which the primary particles chemically bind to each other by a treatment agent described below (i.e., secondarily aggregated particles), more preferably particles in which the primary particles chemically bind to each other by the sol-gel method. The secondary particles are specifically sol-gel silica.

The average particle diameter of the secondary particles; i.e., the average particle diameter of the non-spherical particles, is not particularly limited and may be appropriately selected depending on the intended purpose. From the viewpoint of providing toner particles with stress resistance, it is preferably 60 nm to 480 nm, more preferably 100 nm to 180 nm, particularly preferably 120 nm to 160 nm. When it is less than 60 nm, the secondary particles are susceptible to external stress and may easily be embedded in toner particles. When it is more than 480 nm, the external additive is exfoliated from the toner particles and adheres to a photoconductor. As a result, the external additive is firmly attached on the photoconductor, potentially causing filming. In addition, the photoconductor is damaged by the exfoliated external additive, so that toner cannot be transferred to the photoconductor to potentially form abnormal images. Meanwhile, when the average particle diameter falls within the above preferred range, the number of the contact points between the secondary particles and the toner particles increases, and the spherical particles diffuse externally applied stress; i.e., a force to embed the secondary particles in toner particles, to thereby prevent their embedding advantageously. Even when exfoliated and attached to a photoconductor, the external additive is non-spherical and thus easily scraped off by a cleaning blade; i.e., it hardly remains on the photoconductor, which is advantageous from the viewpoint of preventing abnormal images and filming.

Figure 6:
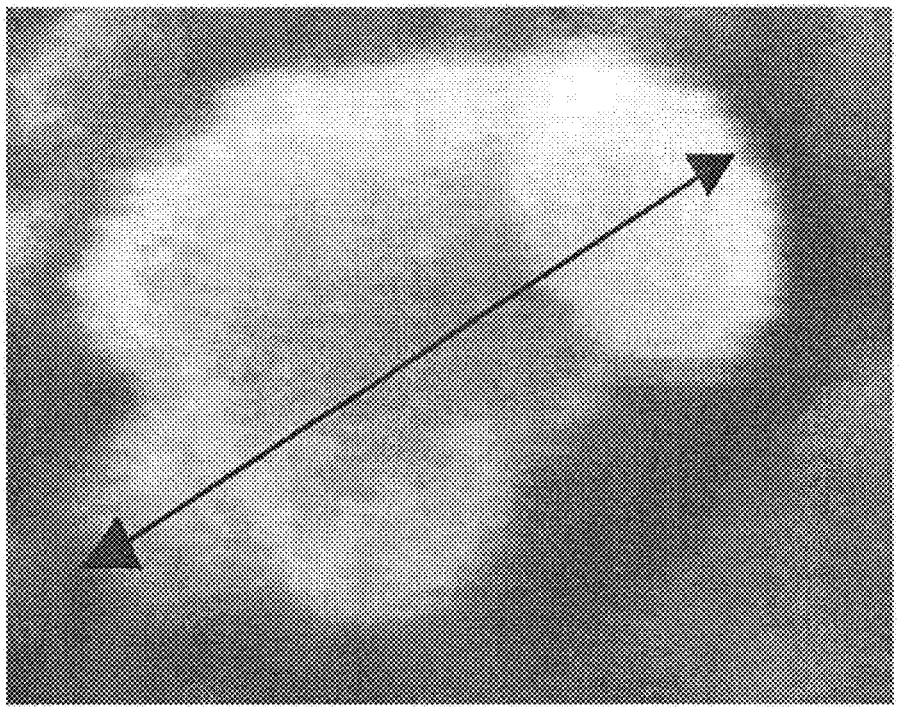
FIG. 6 is a photograph of an example of a toner of the present invention.

The average particle diameter of the secondary particles is measured as follows. Specifically, the secondary particles are dispersed in an appropriate solvent (e.g., THF). The resultant dispersion liquid is subjected to solvent removal to dryness on a substrate to thereby obtain a measurement sample. The measurement sample is observed under a field emission type scanning electron microscope (FE-SEM, acceleration voltage: 5 kV to 8 kV, observed magnification: 8,000 to 10,000) and measured for an average of the longest particle diameters of the whole images predicted from the profiles of the coalesced secondary particles (the length of the arrow in FIG. 6). Here, the number of the secondary particles measured is 100 or more.

—Method for Producing Non-Spherical Particles—

A method for producing the non-spherical particles is not particularly limited and may be appropriately selected depending on the intended purpose, but is preferably a sol-gel method. Specifically, preferred is a method in which the secondary particles (coalesced particles) are produced by mixing or firing the primary particles and a treatment agent to thereby allow them to be chemically bound and secondarily aggregated together. Notably, in the case of the sol-gel method, the coalesced particles may be prepared in a single step reaction in the presence of the treatment agent.

—Treatment Agent—

The treatment agent is not particularly limited and may be appropriately selected depending on the intended purpose. Examples thereof include a silane-based treatment agent and an epoxy-based treatment agent. These may be used alone or in combination. In the case where silica is used as the primary particles, the silane-based treatment agent is preferred in that a Si—O—Si bond formed with the silane-based treatment agent is more thermostable than a Si—O—Si bond formed with the epoxy-based treatment agent. If necessary, a treatment aid (e.g., water or 1% by mass acetic acid aqueous solution) may be used.

—Silane-Based Treatment Agent—

The silane-based treatment agent is not particularly limited and may be appropriately selected depending on the intended purpose. Examples thereof include alkoxysilanes (e.g., tetramethoxysilane, tetraethoxysilane, methyltrimethoxysilane, methyltriethoxysilane, dimethyldimethoxysilane, dimethyldiethoxysilane, methyldimethoxysilane, methyldiethoxysilane, diphenyl dimethoxysilane, isobutyltrimethoxysilane, decyltrimethoxysilane); silane coupling agents (e.g., γ-aminopropyltriethoxysilane, γ-glycidoxypropyltrimethoxysilane, γ-glycidoxypropylmethyldiethoxysilane, γ-methacryloxypropyl trimethoxysilane, γ-mercaptopropyltrimethoxysilane, vinyltriethoxysilane, methylvinyldimethoxysilane); vinyltrichlorosilane, dimethyldichlorosilane, methylvinyldichlorosilane, methylphenyldichlorosilane, phenyltrichlorosilane, N,N'-bis(trimethylsilyl)urea, N,O-bis(trimethylsilyl)acetoamide, dimethyltrimethylsilylamine, hexamethyldisilazane and a mixture of cyclicsilazane.

The silane-based treatment agent chemically binds to the primary particles (e.g., primary silica particles) to thereby allow them to secondarily aggregate together as follows.

In the case where the primary silica particles are treated with, for example, the alkoxysilanes or the silane-based coupling agents serving as the silane-based treatment agent, as shown in the following Formula (A), a silanol group bound to the silica primary particle undergoes a dealcoholization reaction with an alkoxy group bound to the silane-based treatment agent to thereby form a new Si—O—Si bond, resulting in secondarily aggregated particles.

In the case where the primary silica particles are treated with the chlorosilanes serving as the silane-based treatment agent, a chloro group in the chlorosilane undergoes a dehydrochlorination reaction with a silanol group bound to the silane primary particle to thereby form a new Si—O—Si, resulting in secondarily aggregated particles. In the case where the primary silica particles are treated with the chlorosilanes serving as the silane-based treatment agent in the presence of water, the chlorosilanes are firstly hydrolyzed to produce a silanol group, and then the resultant silanol group undergoes a dehydration reaction with a silanol group bound to the silane primary particle to thereby form a new Si—O—Si bond, resulting in secondarily aggregated particles.

In the case where the primary silica particles are treated with silazanes serving as the silane-based treatment agent, an amino group undergoes a deammoniation reaction with a silanol group bound to the silica primary particle to thereby form a new Si—O—Si bond, resulting in secondarily aggregated particles.

—Si—OH+RO—Si—→—Si—O—Si—+ROH Formula (A)

In Formula (A), R represents an alkyl group.

—Epoxy-Based Treatment Agent—

The epoxy-based treatment agent is not particularly limited and may be appropriately selected depending on the intended purpose. Examples thereof include bisphenol A type epoxy resins, bisphenol F type epoxy resins, phenolic novolac type epoxy resins, cresol novolac type epoxy resins, bisphenol A novolac type epoxy resins, biphenol type epoxy resins, glycidylamine type epoxy resins and alicyclic epoxy resins.

The epoxy-based treatment agent chemically binds to the primary particles to thereby allow them to secondarily aggregate together as shown in the following Formula (B). In the case where the primary silica particles are treated with the epoxy-based treatment agent, a silanol group bound to the silica primary particle undergoes an addition reaction with an oxygen group in an epoxy group and a carbon atom bound to the epoxy group in the epoxy-based treatment agent to thereby form a new Si—O—Si bond, resulting in secondarily aggregated particles.

Formula (B)

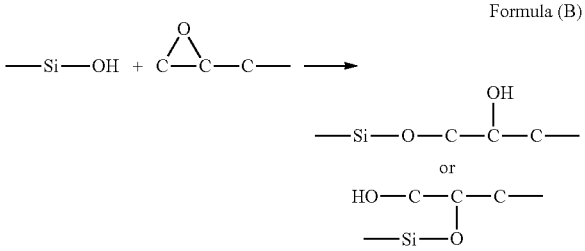

A mixing mass ratio of the treatment agent and the primary particles (primary particles:treatment agent) is not particularly limited and may be appropriately selected depending on the intended purpose, but is preferably 100:0.01 to 100:50. Notably, the more the treatment agent is, the higher the degree of coalescence is.

A method for mixing the treatment agent with the primary particles is not particularly limited and may be appropriately selected depending on the intended purpose. Example thereof includes a method of mixing with known mixers (e.g., spray driers). Notably, the primary particles may be firstly prepared and then the treatment agent may be mixed therewith. Alternatively, the primary particles may be prepared in a single step in the presence of the treatment agent.

A firing temperature of the treatment agent and the primary particles is not particularly limited and may be appropriately selected depending on the intended purpose, but is preferably 100° C. to 2,500° C. The higher the firing temperature is, the higher the degree of coalescence is.

A firing time of the treatment agent and the primary particles is not particularly limited and may be appropriately selected depending on the intended purpose, but is preferably 0.5 hours to 30 hours.

—Properties of Non-Spherical Particles—

An average of degrees of coalescence of the non-spherical particles (i.e., the particle diameter of each of the secondary particles/the average particle diameter of the primary particles) is not particularly limited and may be controlled as desired by adjusting the average particle diameter of the primary particles, the type and amount of a treatment agent, and treatment conditions. The average of degrees of coalescence of the non-spherical particles is preferably 1.7 to 4.0, more preferably 1.8 to 3.9, particularly preferably 2.0 to 3.0. When the average of degrees of coalescence is less than 1.7, the non-spherical particles are substantially identical to the spherical particles in terms of the contact points with the toner particles, so that the external additive may easily be embedded in the toner base particles. When the average of degrees of coalescence is more than 4.0, the primary particles are excessively small, so that the secondary particles cannot have a suitable particle diameter, potentially making it difficult to control the particle diameter of the secondary particles. In addition, the external additive is easily exfoliated from the toner particles, and an image failure may occur over time as a result of a drop in charge amount due to contamination of carrier particles and of damage on a photoconductor. Meanwhile, when the average of degrees of coalescence falls within the above preferred range, silica to be added to toner particles are deformed to have a relatively large particle diameter, which is advantageous.

When the non-spherical particles are sol-gel silica produced by a sol-gel method, carbon derived from an alkoxy group remains. An amount of the alkoxy group-derived carbon in the non-spherical particles is not particularly limited and may be appropriately selected depending on the intended purpose. It is preferably 1% by mass or less since a hydrophobic treatment of the non-spherical particles proceeds, and an amount of water therein decreases and a charge amount thereof increases. When the amount of the carbon remaining is more than 1% by mass, the number of alkoxy groups is large in a product resulting from hydrolytic condensation, making a hydrophobic treatment difficult to perform. As a result, a ratio of water in the non-spherical particles increases due to being high hydrophilicity, so that a charge amount of the obtained toner may be decreased. The amount of the carbon derived from an alkoxy group can be measured as follows. Specifically, 0.1 g of a sample is accurately weighed on a magnetic board. The magnetic board is placed in a burning furnace, followed by burning at about 1,200° C. An amount of $CO_2$ generated during burning is converted to obtain the amount of carbon.

When the non-spherical particles are sol-gel silica produced by a sol-gel method, water remains. An amount of water in the non-spherical particles is not particularly limited and may be appropriately selected depending on the intended purpose. It is preferably 1% by mass or less since a charge amount of the obtained toner increases. When the amount of water is more than 1% by mass, a charge amount of the obtained toner may decrease. The ratio of water remaining in the non-spherical particles can be measured by the dead-stop end-point method using a Karl Fischer titrator; a water content meter of a volumetric titration type (model KF-06, product of Mitsubishi Chemical Corporation). Specifically, 10 μL of pure water is accurately weighed with a microsyringe, and a titration amount of a reagent necessary for removing the water is measured. The obtained value is converted to obtain an amount of water (mg) per 1 mL of a Karl Fischer reagent. Next, 100 mg to 200 mg of a measurement sample is accurately weighed and thoroughly dispersed in a measurement flask with a magnetic stirrer for 5 min. After dispersion, measurement of the sample is started to obtain a total titration amount (mL) of the Karl Fischer reagent necessary for titration, which is used to calculate the ratio of water from the following equations.

$$\text{Ratio of water}(\%)=\text{amount of water}(mg)/\text{amount of sample}(mg)\times 100$$

$$\text{Amount of water}(mg)=\text{amount of reagent consumed}(mL)\times\text{titer of reagent}(mgH_2O/mL)$$

<<Relationship of Non-Spherical Particles and Spherical Particles>>

When the non-spherical particles and the spherical particles satisfy a relationship expressed by the following formula (1), the obtained toner particles can be provided with proper flowability. In addition, the toner particles are not easily damaged when transferred in an actual apparatus and stirred with carrier particles. As a result, the amount of silica exfoliated from the toner particles decreases and it is possible to prevent image failures caused by silica present on a photoconductor. While the non-spherical particles have a sharp particle size distribution, the spherical particles tend to have a broad particle size distribution due to their production method. As a result, the particle size distribution of the coalesced particles (secondary particles) becomes large further, to form ununiform secondary particles such as excessively small particles and excessively large particles. Furthermore, when the non-spherical particles are sol-gel silica and the spherical particles are dry silica, the non-spherical particles have pores unlike the spherical particles and, conceivably, absorb gas and water present in air, leading to improvement in storageability.

$$3Ca(\%)<Cb(\%) \qquad \text{Formula (1)}$$

In the formula (1), Ca is greater than 10% but smaller than 20% and Cb is greater than 40% but smaller than 70%, and Ca and Cb are values given by:

$$Ca=\frac{(\text{an amount of the non-spherical particles (\% by mass)}/100)\times(\text{a projected area of the non-spherical particles (cm}^2/\text{g)})}{(\text{an amount of the toner base particles (\% by mass)}/100)\times(\text{a surface area of the toner base particles (cm}^2/\text{g)})}\times 100$$

$$Cb=\frac{(\text{an amount of the spherical particles (\% by mass)}/100)\times(\text{a projected area of the spherical particles (cm}^2/\text{g)})}{(\text{an amount of the toner base particles (\% by mass)}/100)\times(\text{a surface area of the toner base particles (cm}^2/\text{g)})}\times 100$$

where the surface area of the toner base particles is a value given by: 6/(an average particle diameter of the toner×a specific gravity of the toner);

the projected area of the non-spherical particles is a value given by: 3/(2×an average particle diameter of the non-spherical particles×a specific gravity of the non-spherical particles); and the projected area of the spherical particles is a value given by: 3/(2×an average particle diameter of the spherical particles×a specific gravity of the spherical particles).

In the formula (1), the specific gravity of the toner is a true specific gravity of the toner. The true specific gravity thereof is measured as follows. Specifically, the volume of a sample is measured with a dry-process automated densitometer using a vapor-phase substitution method (ACCUPYC 1330, product of Shimadzu Corporation Ltd.) at a constant temperature with the volume and pressure of gas (He gas) being changed. Then, the mass of the sample is measured from the measured volume thereof, and the density of the sample is determined.

In the formula (1), the specific gravity of the non-spherical particles is a true specific gravity of the non-spherical particles. The true specific gravity thereof is measured as follows. Specifically, the volume of a sample is measured with a dry-process automated densitometer using a vapor-phase substitution method (ACCUPYC 1330, product of Shimadzu Corporation Ltd.) at a constant temperature with the volume and pressure of gas (He gas) being changed. Then, the mass of the sample is measured from the measured volume thereof, and the density of the sample is determined.

In the formula (1), the specific gravity of the spherical particles is a true specific gravity of the spherical particles. The true specific gravity thereof is measured as follows. Specifically, the volume of a sample is measured with a dry-process automated densitometer using a vapor-phase substitution method (ACCUPYC 1330, product of Shimadzu Corporation Ltd.) at a constant temperature with the volume and pressure of gas (He gas) being changed. Then, the mass of the sample is measured from the measured volume thereof, and the density of the sample is determined.

The relationship between Ca and Cb does not satisfy "3Ca<Cb" in the formula (1) and 3Ca is greater than Cb, the obtained toner cannot be provided with sufficient flowability. The relationship between Ca and Cb satisfies "3Ca<Cb" in the formula (1) and 3Ca is excessively smaller than Cb (in the case of Ca≤10%), the non-spherical particles cannot function as a spacer, causing degradation in the toner. Thus, the spherical particles are considerably exfoliated and the exfoliated spherical particles may degrade image quality.

Ca is not particularly limited and may be appropriately selected depending on the intended purpose so long as 10%<Ca<20%, preferably 10%<Ca≤18%, more preferably 13%≤Ca≤18%. When Ca is 10% or less, the non-spherical particles may hardly function as a spacer between toner particles. When Ca is 20% or more, the non-spherical particles covers the toner base particles in an increased area, so that more silica particles may be exfoliated Cb is not particularly limited and may be appropriately selected depending on the intended purpose so long as 40%<Cb<70%, preferably 45%≤Cb<70%, more preferably 50%≤Cb≤60%. When Cb is 40% or less, the obtained toner cannot be provided with sufficient flowability. In addition, the contact area between toner particles increases, potentially degrading storageability thereof. When Cb is 70% or more, more silica particles are exfoliated and the fixing temperature of the obtained toner may be increased.

An amount of the external additives contained is not particularly limited and may be appropriately selected depending on the intended purpose, but is preferably 2 parts by mass to 6 parts by mass relative to 100 parts by mass of the toner base particles.

<Toner Base Particles>

The toner base particles contain at least a binder resin and a colorant; and, if necessary, further contain other ingredients.

<<Binder Resin>>

The binder resin is not particularly limited and may be appropriately selected depending on the intended purpose. Examples thereof include polyester resins, silicone resins, styrene-acrylic resins, styrene resins, acrylic resins, epoxy resins, diene-based resins, phenol resins, terpene resins, coumarin acid, amide-imide resins, butyral resins, urethane resins and ethylene-vinyl acetate resins. These may be used alone or in combination. Among them, preferred are the polyester resins, and a combination of the polyester resins with any of the above-described resins other than the polyester resins, from the viewpoint of being excellent in low temperature fixability, being capable of smoothing an image surface, and having satisfactory flexibility even when the molecular weight thereof is decreased.

—Polyester Resin—

The polyester resin is not particularly limited and may be appropriately selected depending on the intended purpose, but is preferably an unmodified polyester resin or a modified polyester resin. Preferably, the unmodified polyester resin and the modified polyester resin are at least partially compatible with each other from the viewpoints of being improved in low temperature fixability and offset resistance. Therefore, the unmodified polyester resin has preferably similar composition to that of the modified polyester resin.

The amount of the polyester resin in the toner is not particularly limited and may be appropriately selected depending on the intended purpose, but is preferably 50% by mass or more. When it is less than 50% by mass, the toner may be degraded in low temperature fixability.

—Unmodified Polyester Resin—

The unmodified polyester resin is not particularly limited and may be appropriately selected depending on the intended purpose. Examples thereof include resins obtained from polyhydric alcohol components and polyvalent carboxylic acid components (e.g., polyvalent carboxylic acids, polyvalent carboxylic anhydrides, and polyvalent carboxylic acid esters).

The acid value of the unmodified polyester resin is not particularly limited and may be appropriately selected depending on the intended purpose, but is preferably 1 KOHmg/g to 50 KOHmg/g, more preferably 5 KOHmg/g to 30 KOHmg/g. When it falls within the above preferred range, it is advantageous in that the toner tends to be negatively chargeable and is improved in low temperature fixability due to high affinity with paper upon fixing. When it is higher than 50 KOHmg/g, the toner may be degraded in charge stability, particularly depending on a change in the working environment.

The hydroxyl value of the unmodified polyester resin is not particularly limited and may be appropriately selected depending on the intended purpose, but is preferably 5 KOHmg/g or higher. Notably, the hydroxyl value can be measured using, for example, a method according to JIS K0070-1966. Specifically, 0.5 g of a sample is accurately weighed in a 100 mL measuring flask, and then 5 mL of an acetylating reagent is added thereto. Next, the measuring flask is heated in a hot water bath set to 100° C.±5° C. for 1 hour to 2 hours. Then, the measuring flask is taken out from the hot water bath and left to cool. In addition, water is added to the measuring flask, which is then shaken to thereby decompose acetic anhydride. Next, in order to completely decompose acetic anhydride, the measuring flask is heated again in the hot water bath for 10 min or longer and then left to cool. Thereafter, the wall of the flask is thoroughly washed with an organic solvent. Then, the hydroxyl value is measured at 23° C. using potentiometric automatic titrator DL-53 (product of Mettler-Toledo K.K.) and electrode DG113-SC (product of Mettler-Toledo K.K.), and analyzed using analysis software (LabX Light Version 1.00.000). The titrator is calibrated with a solvent mixture of toluene (120 mL) and ethanol (30 mL). The hydroxyl value is measured under the following measurement conditions shown in Table 1.

TABLE 1

| | |
|---|---|
| Stir | |
| Speed [%] 25 | |
| Time [s] 15 | |
| EQP titration | |
| Titrant/Sensor | |
| Titrant $CH_3ONa$ | |
| Concentration [mol/L] 0.1 | |
| Sensor DG115 | |
| Unit of measurement mV | |
| Predispensing to volume | |
| Volume [mL] | 1.0 |
| Wait time [s] | 0 |
| Titrant addition Dynamic | |
| dE (set) [mV] | 8.0 |
| dV (min) [mL] | 0.03 |
| dV (max) [mL] | 0.5 |
| Measure mode | Equilibrium controlled |
| dE [mV] | 0.5 |
| dt [s] | 1.0 |
| t (min) [s] | 2.0 |
| t (max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs | Yes |
| n = 1 | |
| comb. Termination conditions | No |
| Evaluation | |
| Procedure | Standard |
| Potential1 | No |
| Potential2 | No |
| Stop for reevaluation | No |

—Modified Polyester Resin—

The modified polyester resin can provide a toner with a proper crosslinked structure. The modified polyester resin is not particularly limited and may be appropriately selected depending on the intended purpose so long as it is a resin containing a urethane bond, a urea bond or both thereof. Since an improvement is made in a fixable range (i.e., a difference between the minimum fixing temperature and the offset-occurring temperature), the modified polyester resin is preferably a resin obtained through elongation and/or crosslinking reaction between an active hydrogen group-containing compound and a polyester resin having a functional group reactive with an active hydrogen group of the active hydrogen group-containing compound (hereinafter this polyester resin may be referred to as "polyester prepolymer").

In the synthesis of the modified polyester resin, a method for allowing the active hydrogen group-containing compound and the polyester prepolymer to undergo elongation and/or crosslinking reaction is not particularly limited and may be appropriately selected depending on the intended purpose. Examples thereof include: a method where the active hydrogen group-containing compound is added to an aqueous phase described below and then toner materials are dispersed in the aqueous phase to perform reaction; and a method where toner materials are dispersed in an aqueous phase described below and then the active hydrogen group-containing compound is added to the aqueous phase to perform reaction from the interfaces between particles. In the latter method, the modified polyester is formed from polyester prepolymer preferentially on the surfaces of the toner particles produced, which can provide concentration a gradient from the surface to the core of the particles. If necessary, a known catalyst (e.g., tertiary amines (e.g., triethylamine) and imidazole) and/or a known solvent (e.g., aromatic compounds (e.g., toluene and xylene); ketones (e.g., acetone, methyl ethyl ketone and methyl isobutyl ketone); esters (e.g., ethyl acetate); amides (dimethylformamide and dimethylacetamide); and ethers (e.g., tetrahydrofuran)) may be used.

In the synthesis of the modified polyester resin, the time for the elongation and/or crosslinking reaction is not particularly limited and may be appropriately selected depending on reactivity between the polyester prepolymer and the active hydrogen group-containing compound used in combination, but is preferably 10 min to 40 hours, more preferably 30 min to 24 hours.

In the synthesis of the modified polyester resin, the temperature for the elongation and/or crosslinking reaction is not particularly limited and may be appropriately selected depending on the intended purpose, but is preferably 0° C. to 100° C., more preferably 10° C. to 50° C.

The weight average molecular weight of the modified polyester resin is not particularly limited and may be appropriately selected depending on the intended purpose, but is preferably 10,000 to 300,000.

—Active Hydrogen Group-Containing Compound—

The active hydrogen group-containing compound is not particularly limited and may be appropriately selected depending on the intended purpose so long as it is a compound that acts as, for example, an elongating agent and a crosslinking agent in an aqueous medium when the polyester prepolymer is allowed to undergo, for example, elongation reaction and/or crosslinking reaction. Examples of the compound include amines. The amines are not particularly limited and may be appropriately selected depending on the intended purpose. Examples thereof include: diamine compounds (e.g., aromatic diamines such as phenylenediamine, diethyltoluenediamine and 4,4'-diaminodiphenylmethane); alicyclic diamines (e.g., 4,4'-diamino-3,3'-dimethyldicyclohexylmethane, diaminecyclohexane and isophoronediamine); aliphatic diamines (e.g., ethylenediamine, tetramethylenediamine and hexamethylenediamine)); tri- or higher-valent polyamines (e.g., diethylenetriamine and triethylenetetramine); amino alcohol compounds (e.g., ethanolamine and hydroxyethylaniline); aminomercaptans (e.g., aminoethyl mercaptan and aminopropyl mercaptan); amino acid compounds (e.g., aminopropionic acid and aminocaproic acid); and amino-blocked products (e.g., oxazolidine compounds and ketimine compounds produced from the above amines and ketones (e.g., acetone, methyl ethyl ketone and methyl isobutyl ketone)). These may be used alone or in combination. Among them, preferred are the diamine compounds and mixtures of the diamine compounds and a small amount of the polyamine compounds.

—Polyester Prepolymer—

The polyester prepolymer is not particularly limited and may be appropriately selected depending on the intended purpose so long as it is a polyester resin containing at least a functional group reactive with an active hydrogen group of the active hydrogen group-containing compound. The functional group of the polyester prepolymer, which is reactive with the active hydrogen group, is not particularly limited and may be appropriately selected from known substituents. Examples thereof include an isocyanate group, an epoxy group, carboxylic acid and an acid chloride group. One type of the functional group or two or more types of them may be contained in the polyester resin. Among them, an isocyanate group is preferred.

The synthesis method of the polyester prepolymer is not particularly limited and may be appropriately selected depending on the intended purpose. Examples thereof include a method where a polyester resin serving as a base material is reacted and modified with a conventionally known isocyanating agent or an epoxidizing agent such as epichlorohydrin.

The isocyanating agent is not particularly limited and may be appropriately selected depending on the intended purpose. Examples thereof include: aliphatic polyisocyanates (e.g., tetramethylene diisocyanate, hexamethylene diisocyanate and 2,6-diisocyanatomethyl caproate); alicyclic polyisocyanates (e.g., isophoron diisocyanate and cyclohexylmethane diisocyanate); aromatic diisocyanates (e.g., tolylene diisocyanate and diphenylmethane diisocyanate); aromatic aliphatic diisocyanates (e.g., α,α,α',α'-tetramethylxylylene diisocyanate); isocyanurates; and compounds formed by blocking the above isocyanates with, for example, a phenol derivative, an oxime derivative or a caprolactam derivative. These may be used alone or in combination.

A ratio of the isocyanating agent to the polyester resin is not particularly limited and may be appropriately selected depending on the intended purpose. It is preferably 5/1 to 1/1, more preferably 4/1 to 1.2/1, particularly preferably 2.5/1 to 1.5/1, in terms of the equivalent ratio [NCO]/[OH] of isocyanate groups [NCO] in the isocyanating agent to hydroxyl groups [OH] in the polyester resin which serves as a base material. When the equivalent ratio [NCO]/[OH] is less than 1, the formed toner may be deteriorated in offset resistance since the urea content of the polyester prepolymer is decreased. When it is more than 5/1, the formed toner may be deteriorated in low temperature fixability.

An amount of the polyisocyanate contained in the polyester prepolymer is not particularly limited and may be appropriately selected depending on the intended purpose, but is preferably 0.5% by mass to 40% by mass, more preferably 1% by mass to 30% by mass, particularly preferably 2% by mass to 20% by mass. When the amount is less than 0.5% by mass, the formed toner may be deteriorated in hot offset resistance, potentially making it difficult to achieve both heat resistance storageability and low temperature fixability. When the amount is greater than 40% by weight, the formed toner may be deteriorated in low temperature fixability.

An average number of isocyanate groups contained in one molecule of the polyester prepolymer is not particularly limited and may be appropriately selected depending on the intended purpose, but is preferably 1 or more, more preferably 1.5 to 3, particularly preferably 1.8 to 2.5. When the average number is less than 1, the urea-modified polyester resin formed after elongation reaction decreased in the molecular weight, which may deteriorate hot offset resistance.

When the urea-modified polyester resin (isocyanate group-containing polyester prepolymer) is synthesized as the polyester prepolymer, the urea-modified polyester resin can be synthesized by, for example, a one-shot method. Specifically, the polyol and the polycarboxylic acid are heated to 150° C. to 280° C. in the presence of a known esterification catalyst (e.g., tetrabutoxytitanate or dibutyltinoxide) with, if necessary, appropriately reducing pressure to remove produced water to thereby obtain a hydroxyl group-containing polyester. Next, the hydroxyl group-containing polyester is allowed to react with the polyisocyanate at 40° C. to 140° C. to thereby obtain the polyester prepolymer. Notably, when the urea-modified polyester resin and the unmodified polyester resin are used in combination, the unmodified polyester resin produced in the same manner as in the hydroxyl group-containing polyester resin may be mixed with a solution after reaction of the urea-modified polyester resin. Also, besides the unmodified polyester resin, the urea-modified polyester resin may be used in combination with a polyester resin modified with other chemical bonds than the urea bond (e.g., a polyester resin modified with a urethane bond).

If necessary, a solvent may be used in a reaction of the polyisocyanate with the hydroxyl group-containing polyester resin for synthesizing the polyester prepolymer. The solvent is not particularly limited and may be appropriately selected depending on the intended purpose. Examples thereof include solvents which are non-reactive with an isocyanate group such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran).

A number average molecular weight of the polyester prepolymer is not particularly limited and may be appropriately selected depending on the intended purpose, but is preferably 1,000 to 10,000, more preferably 1,500 to 6,000, in the case of the urea-modified polyester resin.

<<Colorant>>

The colorant is not particularly limited and may be appropriately selected from any known dyes or pigments depending on the intended purpose. Examples of the colorant include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These may be used alone or in combination.

An amount of the colorant contained in the toner is not particularly limited and may be appropriately selected depending on the intended purpose, but is preferably 1% by mass to 15% by mass, more preferably 3% by mass to 10% by mass.

The colorant may be mixed with a resin to form a masterbatch. A method for producing the masterbatch is not particularly limited and may be appropriately selected depending on the intended purpose. For example, the masterbatch can be produced by mixing or kneading the colorant and an organic solvent with a resin for use in a masterbatch through application of high shearing force. Notably, the organic solvent is added in order to enhance interactions between the colorant and the binder resin. Also, the other method for producing the masterbatch is not particularly limited and may be appropriately selected depending on the intended purpose, but a flashing method, in which an aqueous paste containing a colorant is mixed or kneaded with the binder resin and an organic solvent and then the colorant is transferred to the resin followed by removing water and the organic solvent, is preferable in that a wet cake of the colorant can be directly used (i.e., no drying is required). Notably, in this mixing or kneading, a high-shearing disperser (e.g., three-roll mill) is preferably used.

<Other Ingredients>

The other ingredients are not particularly limited and may be appropriately selected depending on the intended purpose. Examples thereof include a cleanability improving agent, a releasing agent and a charge controlling agent.

—Cleanability Improving Agent—

The cleanability improving agent is not particularly limited and may be appropriately selected depending on the intended purpose, so long as it is added to the toner in order to facilitate removal of the developer remaining on a photoconductor and a primary transfer medium after transfer. Examples thereof include fatty acid metal salts such as zinc stearate, calcium stearate, and stearic acid; and polymer particles produced through soap-free emulsification polymerization such as polymethyl methacrylate particles and polystyrene particles. A volume average particle diameter of the polymer particle is not particularly limited and may be appropriately selected depending on the intended purpose, but preferably has a relatively narrow particle size distribution, more preferably is 0.01 μm to 1 μm.

—Releasing Agent—

The releasing agent is not particularly limited and may be appropriately selected depending on the intended purpose. Examples thereof include waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum); those other than natural waxes such as synthetic hydrocarbon waxes (e.g., Fischer-Tropsch waxes and polyethylene waxes) and synthetic waxes (e.g., ester waxes, ketone waxes and ether waxes); fatty acid amides such as 1,2-hydroxystearic acid amide, stearic amide, phthalic anhydride imide and chlorinated hydrocarbons; crystalline polymers having a long chain alkyl group as a side chain (e.g., homopolymers or copolymers of low-molecular weight crystalline polymers such as poly-n-stearyl methacrylate and poly-n-lauryl methacrylate (e.g., n-stearyl acrylate-ethyl methacrylate copolymers)). Among them, preferred is a wax having a melting point of 50° C. to 120° C. from the viewpoint of effectively exhibiting its releasing effects on an interface between a fixing roller and each toner particle. Thus, even when a releasing agent such as oil is not applied onto the fixing roller, excellent hot offset resistance can be attained. Notably, the melting point of the releasing agent is determined by measuring the maximum endothermic peak using a differential scanning calorimeter TG-DSC system TAS-100 (product of Rigaku Corporation).

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, metal salts of salicylic acid derivatives, copper phthalocyanine, perylene, quinacridone, azo pigments, and polymeric compounds having a functional group (e.g., a sulfonic acid group, carboxyl group or quaternary ammonium salt).

Examples of commercially available charge controlling agents include BONTRON 03 (nigrosine dye), BONTRON P-51 (quaternary ammonium salt), BONTRON S-34 (metal-containing azo dye), E-82 (oxynaphthoic acid-based metal complex), E-84 (salicylic acid-based metal complex) and E-89 (phenol condensate) (all products of ORIENT CHEMICAL INDUSTRIES CO., LTD); TP-302 and TP-415 (quaternary ammonium salt molybdenum complex (all products of Hodogaya Chemical Co.); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (all products of Clariant (Japan) K.K.); LRA-901 and LR-147 (all products of Japan Carlit Co., Ltd.).

The amount of the charge controlling agent is not particularly limited and may be appropriately selected depending on the intended purpose. It is preferably 0.1 parts by mass to 10 parts by mass, more preferably 0.2 parts by mass to 5 parts by mass, per 100 parts by mass of the binder resin. When the amount of the charge controlling agent is more than 10 parts by mass, the formed toner has too high chargeability, resulting in that the charge controlling agent exhibits reduced effects. As a result, the electrostatic force increases between the developing roller and the developer, possibly leading to lowered fluidity of the developer and lowered image density. The charge controlling agent may be melt-kneaded together with toner materials such as a masterbatch or resin before dissolution or dispersion. Alternatively, it may be directly added at the time when toner materials are dissolved or dispersed in an organic solvent. Alternatively, after the formation of toner particles on the toner surface, it may be fixed on the toner particles.

<Method for Producing Toner>

A method for producing the toner is not particularly limited and may be appropriately selected depending on the intended purpose, but preferably includes an aqueous phase preparing step, an oil phase preparing step, an emulsification or dispersion step, a solvent removing step, a washing and drying step and an external additive treatment step. Specifically, one preferred method thereof includes: dissolving or dispersing at least a colorant, a binder resin precursor and other ingredients in an organic solvent to obtain an oil phase and dissolving in the oil phase a compound able to be elongated or crosslinked with the binder resin precursor; dispersing the oil phase in an aqueous phase in the presence of a dispersing agent to obtain an emulsion or dispersion; allowing the binder resin precursor to undergo crosslinking or elongating reaction in the emulsion or dispersion; removing the organic solvent to obtain toner base particles; and adding the external additive to the toner base particles.

<<Oil Phase Preparing Step>>

The oil phase preparing step is a step of preparing an oil phase (a solution or dispersion liquid of toner materials) by dissolving or dispersing the toner materials containing at least the binder resin and the colorant in an organic solvent. The organic solvent is not particularly limited and may be appropriately selected depending on the intended purpose, but preferably is an organic solvent having a boiling point of lower than 150° C. from the viewpoint of easily removing the solvent. The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Among them, preferred are ethyl acetate, toluene, xylene, benzene, methylene chloride, 1,2-dichloroethane, chloroform, carbon tetrachloride, and more preferred is ethyl acetate.

<<Aqueous Phase Preparing Step>>

The aqueous phase preparing step is a step of preparing an aqueous phase (aqueous medium). The aqueous phase is not particularly limited and may be appropriately selected depending on the intended purpose. Examples thereof include water, a water-miscible solvent, and a mixture thereof. These may be used alone or in combination. Among them, preferred is water. Examples of the water-miscible solvent include alcohols (e.g., methanol, isopropanol and ethylene glycol), dimethylformamide, tetrahydrofuran, cellosolves (e.g., methyl cellosolve (registered trademark)) and lower ketones (e.g., acetone and methyl ethyl ketone).

<<Emulsification or Dispersion Step>>

The emulsification or dispersion step is a step of dispersing the oil phase in the aqueous phase to thereby obtain an emulsion or dispersion. The toner materials may not necessarily added to the aqueous phase before particle formation. The toner materials may be added to the aqueous phase after particle formation. For example, after particles containing no colorant are formed, a colorant may be added to the obtained particles using a known dying method. An amount of the aqueous phase used is not particularly limited and may be appropriately selected depending on the intended purpose. It is preferably 100 parts by mass to 1,000 parts by mass per 100 parts by mass of the toner materials. When the amount of the aqueous medium used is less than 100 parts by mass, the toner materials are poorly dispersed, resulting in that toner particles having a predetermined particle diameter cannot obtained in some cases. When the amount of the aqueous medium used is more than 1,000 parts by mass, the production cost may be elevated. If necessary, a dispersing agent may be used. Use of the dispersing agent is preferred from the viewpoints of attaining a sharp particle size distribution and allowing the toner materials to be stably dispersed.

The dispersing agent used in the emulsification or dispersion step is not particularly limited and may be appropriately selected depending on the intended purpose. Examples thereof include anionic surfactants, cationic surfactants, nonionic surfactants, amphoteric surfactants, fluoroalkyl group-containing anionic surfactants, fluoroalkyl group-containing cationic surfactants, inorganic compounds (e.g., tricalcium phosphate, calcium carbonate, titanium oxide, colloidal silica, and hydroxyapatite), polymer particles (e.g., methyl methacrylate (MMA) polymer particles of 1 μm and 3 μm, styrene particles of 0.5 μm and 2 μm, and styrene-acrylonitrile polymer particles of 1 μm). Among them, preferred are fluoroalkyl group-containing surfactants from the viewpoint of being capable of exhibiting its dispersing effects even in a very small amount.

Examples of commercially available dispersion agents include SURFLON S-111, S-112, S-113 and S-121 (all products of Asahi Glass Co., Ltd.); FRORARD FC-93, FC-95, FC-98, FC-129 and FC-135 (all products of Sumitomo 3M Ltd.); UNIDYNE DS-101, DS-102 and DS-202 (all products of Daikin Industries, Ltd.); MEGAFACE F-110, F-120, F-113, F-150, F-191, F-812, F-824 and F-833 (all products of DIC, Inc.); EFTOP EF-102, 103, 104, 105, 112, 123A, 123B, 132, 306A, 501, 201 and 204 (all products of Tohchem Products Co., Ltd.); and FUTARGENT F-100, F-300 and F150 (all products of NEOS COMPANY LIMITED).

In the case where the dispersing agent is used, the dispersing agent may remain on the surfaces of the toner particles. However, the dispersing agent is preferably removed by washing after reaction from the viewpoint of chargeability of the formed toner. The dispersing agent is further preferably removed using a solvent in which the modified polyester after reaction of the polyester prepolymer can be dissolved from the viewpoint of attaining a sharp particle size distribution and decreasing the viscosity of the toner materials. The solvent is preferably a volatile solvent having a boiling point of lower than 100° C. from the viewpoint of easiness of removal. Examples thereof include water-miscible solvents such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, tetrahydrofuran and methanol. These may be used alone or in combination. Among them, preferred are aromatic solvents such as toluene and xylene; and halogenated hydrocarbons such as methylene chloride, 1,2-dichloroethane, chloroform and carbon tetrachloride. The amount of the solvent is not particularly limited and may be appropriately selected depending on the intended purpose, but is preferably 0 parts by mass to 300 parts by mass, more preferably 0 parts by mass to 100 parts by mass, particularly preferably 25 parts by mass to 70 parts by mass, per 100 parts by mass of the polyester prepolymer. When it is used, the solvent is removed with heating under normal or reduced pressure after completion of the elongation or cross-linking reaction.

In the case where the dispersing agent is used, a dispersing stabilizer is preferably used. The dispersing stabilizer is not particularly limited and may be appropriately selected depending on the intended purpose, so long as it is a compound able to stabilize dispersed-liquid droplets with, for example, water-insoluble organic particles or a polymeric protective colloid. Examples thereof include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide); vinyl alcohols and ethers thereof (e.g., vinyl methyl ether, vinyl ethyl ether and vinyl propyl ether); esters of vinyl alcohols and carboxyl group-containing compounds (e.g., vinyl acetate, vinyl propionate and vinyl butyrate); acrylamide, methacrylamide, diacetoneacrylamide and methylol compounds thereof; acid chlorides (e.g., acrylic acid chloride and methacrylic acid chloride); homopolymers or copolymers of nitrogen-containing compounds or nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester and polyoxyethylene nonylphenyl ester); and celluloses (e.g., methyl cellulose, hydroxyethyl cellulose and hydroxypropyl cellulose).

When an acid- or alkali-soluble compound (e.g., calcium phosphate) is used as the dispersion stabilizer, the calcium phosphate used is dissolved with an acid (e.g., hydrochloric acid), followed by washing with water, to thereby remove it from the formed particles. Also, the calcium phosphate may be removed through enzymatic decomposition.

The disperser used in the emulsification or dispersion step is not particularly limited and may be appropriately selected depending on the intended purpose. Examples thereof include a low-speed shearing disperser, a high-speed shearing disperser, a friction disperser, a high-pressure jetting disperser or an ultrasonic disperser. Among them, the high-speed shearing disperser is preferred in that dispersoids (oil droplets) can be controlled so as to have a particle diameter of 2 μm to 20 μm. When the high-speed shearing disperser is used, dispersion conditions such as a rotating speed, a dispersion time or a dispersion temperature are not particularly limited and may be appropriately selected depending on the intended purpose. The rotating speed is not particularly limited and may be appropriately selected depending on the intended purpose, but is preferably 1,000 rpm to 30,000 rpm, more preferably 5,000 rpm to 20,000 rpm. The dispersion time is not particularly limited and may be appropriately selected depending on the intended purpose, but is preferably 0.1 min to 5 min in a batch manner. The dispersion temperature is not particularly limited and may be appropriately selected depending on the intended purpose, but is preferably 0° C. to 150° C., more preferably from 40° C. to 98° C. under pressure. Generally, the higher dispersion temperature is, the easier dispersoids are dispersed.

<<Solvent Removing Step>>

The solvent removing step is a step of removing the solvent from the emulsion or dispersion (dispersion liquid such as emulsified slurry). A method for removing the solvent is not particularly limited and may be appropriately selected depending on the intended purpose. There can be employed a method in which the entire system is gradually increased in temperature to completely evaporate off the organic solvent contained in the oil droplets. Alternatively, there can be employed a method in which the dispersion liquid is sprayed (using, for example, a spray dryer, a belt dryer or a rotary kiln) to a dry atmosphere (heated gas of, for example, air, nitrogen, carbon dioxide or combustion gas), to thereby evaporate off the solvent contained in the oil droplets. This method, even in a short time, allows to sufficiently remove the organic solvent. Removal of the solvent results in forming the toner base particles.

<<Washing or Drying Step>>

The washing or drying step is a step of washing or drying the toner base particles. The toner base particles may be further classified. The toner base particles may be classified by removing particles using, for example, a cyclone, a decanter or a centrifuge in liquid. Alternatively, post-dried toner base particles may be classified. Notably, fine or coarse particles that have been removed by classifying may be used again for forming particles. In this case, these fine or coarse particles may be in a wet state.

<<External Additive Treatment Step>>

The external additive treatment step is a step of mixing and treating post-dried toner base particles with the external additive which meets a specific parameter defined in the present invention. Mixing the toner base particles with the external additive results in the toner of the present invention. A device used in the mixing is not particularly limited and may be appropriately selected depending on the intended purpose, but is preferably HENSCHEL MIXER (product of NIPPON COKE & ENGINEERING COMPANY, LIMITED.) Notably, mechanical impact can be applied in order to prevent the external additive from being exfoliated from the surfaces of the toner base particles. A method for applying mechanical impact is not particularly limited and may be appropriately selected depending on the intended purpose. Examples thereof include a method in which impact is applied to a mixture using a high-speed rotating blade and a method in which a mixture is caused to pass through a high-speed airflow for acceleration to thereby allow particles to collide with each other or with an appropriate collision plate. A device used in applying mechanical impact is not particularly limited and may be appropriately selected depending on the intended purpose. Examples thereof include ONGMILL (product of Hosokawa Micron Corp.), a modified I-type mill (product of Nippon Neumatic Co., Ltd.) so as to reduce the pulverizing air pressure, HYBRIDIZATION SYSTEM (product of Nara Machinery Co., Ltd.), CRYPTRON SYSTEM (production of Kawasaki Heavy Industries, Ltd.) and an automatic mortar.

<Properties of Toner>

A toner of the present invention has proper flowability resulting from preventing additives from embedding and can prevent formation of abnormal images. The abnormal images involve ununiformity in image density due to ununiform printing of images when an image having a large image area is printed. This phenomenon results from aggregation of toner particles in the image forming apparatus during transfer and inaccurate transfer due to irregularities of paper. When silica particles having relatively small particle diameters are added to the toner, the silica particles can provide the toner with flowability, while disadvantageously, the silica particles tend to be embedded in the toner particles by application of stress in the image forming apparatus. Therefore, the particle diameter of the silica particles is preferably large in some degrees for providing the toner with stress resistance.

A ratio (Dv/Dn) of a volume average particle diameter (Dv) to a number average particle diameter (Dn) of the toner is not particularly limited and may be appropriately selected depending on the intended purpose. It is preferably 1.00 to 1.20 since the toner can uniformly be charged with the silica having an even sharp particle size distribution. When the ratio (Dw/Dn) is less than 1.00, the following problems occur. Specifically, for a two-component developer, when stirring for a long period of time in a developing device, the toner is fused to a surface of a carrier, possibly leading to lowered charging ability of the carrier and deteriorated cleanability. For a one-component developer, it is likely to cause a filming of the toner on a developing roller and to fuse the toner on a member such as a blade for thinning a toner layer. When the ratio (Dw/Dn) exceeds 1.20, high-quality images with a high resolution cannot be formed without difficulties. In this case, when the toner is introduced and consumed in a developer, a fluctuation in particle diameters of the toner may be increased. In addition, it may be difficult for the toner to be uniformly charged.

The volume average particle diameter (Dv) and the number average particle diameter (Dn) of the toner can be measured using a particle size analyzer ("MULTISIZER III," product of Beckman Coulter Co.) with the aperture diameter being set to 100 μm, and the obtained measurements are analyzed with an analysis software (Beckman Coulter Multisizer 3 Version 3.51). Specifically, a 10% by mass surfactant (alkylbenzene sulfonate, NEOGEN SC-A, product of Daiichi Kogyo Seiyaku Co.) (0.5 mL) is added to a 100 mL-glass beaker, and a toner sample (0.5 g) is added thereto, followed by stirring with a microspartel. Subsequently, ion-exchange water (80 mL) is added to the beaker, and the obtained dispersion liquid is dispersed with an ultrasonic wave disperser (W-113MK-II, product of Honda Electronics Co.) for 10 min. The resultant dispersion liquid is measured using the above particle size analyzer and ISOTON III (product of Beckman Coulter Co.) serving as a solution for measurement. The dispersion liquid containing the toner sample is dropped so that the concentration indicated by the meter falls within a range of 8%±2%. In this method, it is important that the concentration is adjusted to 8%±2%, considering measurement reproducibility with respect to the particle diameter of the toner. No measurement error in particle diameter is observed, as long as the concentration falls within the above range.

(Developer)

A developer of the present invention contains at least the toner of the present invention; and, if necessary, further contains other ingredients. The developer may be a one-component developer or a two-component developer. In the case that the developer is a two-component developer, a mixture of the toner of the present invention and a carrier may be used. In the case that the developer is a one-component developer, the toner of the present invention may be used as a one-component magnetic or non-magnetic toner.

The developer is preferably a two-component developer containing at least the toner of the present invention and the carrier.

<Carrier>

The carrier includes magnetic core particles and a coating resin which coats the core particles; and, if necessary, further includes electroconductive powder and a silane coupling agent. The particle diameters of the carrier and of the core particles serving as carrier skeleton are important factors.

A content ratio of the carrier to the toner is not particularly limited and may be appropriately selected depending on the intended purpose. The carrier is preferably included in an amount of 1 part by mass to 10 parts by mass, per 100 parts by mass of the carrier.

—Core Particles—

The core particles are not particularly limited and may be appropriately selected depending on the intended purpose, so long as it has magnetization of 40 emu/g or more when a magnetic field of 1,000 Oersteds (Oe) is applied to the carrier. Examples thereof include ferromagnetic materials such as iron and cobalt; magnetite, hematite, Li based ferrite, Mn—Zn based ferrite, Cu—Zn based ferrite, Ni—Zn based ferrite, Ba based ferrite and Mn based ferrite. Crushed particles of a magnetic material can be used as the core particles. When the core particles are made of ferrite or magnetite, primarily granulated product of pre-sintered particles are classified and sintered, and the sintered particles are then classified into particulate powders having different particle size distributions, and a plurality of the particulate powders are mixed to thereby obtain the core particles.

A method of classifying the core particles is not particularly limited and may be appropriately selected depending on the intended purpose. Examples thereof include conventional known classifying methods using, for example, sieve machines, gravitational classifiers, centrifugal classifiers and inertial classifiers. Among them, preferred are air classifiers such as gravitational classifiers, centrifugal classifiers and inertial classifiers.

—Coating Resin—

The coating resin is not particularly limited and may be appropriately selected depending on the intended purpose. Examples thereof include amino-based resins, urea-formaldehyde resins, melamine resins, benzoguanamine resins, urea resins, polyamide resins, polyvinyl resins, polyvinylidene-based resins, acrylic resins, polymethyl methacrylate resins, polyacrylonitrile resins, polyvinyl acetate resins, polyvinyl alcohol resins, polyvinyl butyral resins, polystyrene resins, polystyrene-based resins (e.g., styrene-acrylic copolymers resins), halogenated olefin resins (e.g., polyvinyl chloride resins), polyester-based resins (e.g., polyethylene terephthalate resins and polybutyrene terephthalate resins), polycarbonate-based resins, polyethylene resins, polyvinyl fluoride resins, polyvinylidene fluoride resins, polytrifluoroethylene resins, polyhexafluoropropylene resins; copolymers of vinylidene fluoride and an acrylic monomer; copolymers of vinylidene fluoride and vinyl fluoride; fluoroterpolymers (e.g., terpolymers of tetrafluoroethylene, vinylidene fluoride and a non-fluorinated monomer); silicone resins and epoxy resin. These may be used alone or in combination. Among them, preferred are silicone resins.

The silicone resin is not particularly limited and may be appropriately selected depending on the intended purpose. Examples thereof include: straight silicone resins; and modified silicones such as epoxy-modified silicones, acryl-modified silicones, phenol-modified silicones, urethane-modified silicones, polyester-modified silicones and alkyd-modified silicones. Examples of commercially available products of the straight silicone resins include: KR271, KR272, KR282, KR252, KR255 and KR152 (these products are of Shin-Etsu Chemical Co., Ltd.); and SR2400 and SR2406 (these products are of Dow Corning Toray Co., Ltd.). Examples of commercially available products of the modified silicone resins include: ES-1001N, KR-5208, KR-5203, KR-206, KR-305 (these products are of Shin-Etsu Chemical Co., Ltd.), SR2115 and SR2110 (these products are of Dow Corning Toray Co., Ltd.).

A resin suitably used in combination with the above silicone resin is not particularly limited and may be appropriately selected depending on the intended purpose. Examples thereof include polystyrenes, polychlorostyrenes, poly(α-methylstyrenes), styrene-chlorostyrene copolymers, styrene-propylene copolymers, styrene-butadiene copolymers, styrene-vinylchloride copolymers, styrene-vinyl acetate copolymers, styrene-maleic acid copolymers, styrene-acrylic acid ester copolymers (e.g., styrene-methyl acrylate copolymers, styrene-ethyl acrylate copolymers, styrene-butyl acrylate copolymers, styrene-octyl acrylate copolymers and styrene-phenyl acrylate copolymers), styrene-methacrylic acid ester copolymers (e.g., styrene-methyl methacrylate copolymers, styrene-ethyl methacrylate copolymers, styrene-butyl methacrylate copolymers and styrene-phenyl methacrylate copolymers), styrene resins (e.g., styrene-α-chloromethyl acrylate copolymers and styrene-acrylonitrile-acrylic acid ester copolymers), epoxy resins, polyester resins, polyethylene resins, polypropylene resins, ionomer resins, polyurethane resins, ketone resins, ethylene-ethyl acrylate copolymers, xylene resins, polyamide resins, phenol resins, polycarbonate resins, melamine resins and fluorine resins.

A compound suitably used in combination with the above silicone resin is not particularly limited and may be appropriately selected depending on the intended purpose. It is preferably an aminosilane coupling agent since a carrier having good durability can be obtained. An amount of the aminosilane coupling agent in the coating layer is not particularly limited and may be appropriately selected depending on the intended purpose, but is preferably 0.001% by mass to 30% by mass.

—Method for Producing Carrier—

A method for producing the carrier is not particularly limited and may be appropriately selected depending on the intended purpose. Example thereof includes a method in which coating layers are formed on surfaces of the core particles. The method for forming coating layers on surfaces of the core particles is not particularly limited and may be appropriately selected depending on the intended purpose. Examples thereof include a spray-dry method, an immersion method, and a power-coating method. Among them, a method using a fluidized bed coating apparatus is preferred from the viewpoint of forming a uniform coating layer. The thickness of the coating layer on the surface of the core particles is not particularly limited and may be appropriately selected depending on the intended purpose, but is preferably 0.02 μm to 1 μm, more preferably 0.03 μm to 0.8 μm. Since the thickness of the coating layer is quite small, the particle diameter of the carrier core particles is substantially the same as that of the carrier particles where the coating layer is formed on the surfaces of the carrier core particles.

—Properties of Carrier—

The carrier is not particularly limited and may be appropriately selected depending on the intended purpose, but is preferably a carrier having a sharp, uniform particle size distribution. It is preferable to use carrier particles and carrier core particles defined in number average particle diameter (Dp) as well as weight average particle diameter (Dw).

The weight average particle diameter (Dw) of the carrier is not particularly limited and may be appropriately selected depending on the intended purpose, but is preferably 20 μm to 45 μm. When the weight average particle diameter Dw is less than 20 μm, particles having low magnetism are present in many places in the formed magnetic brush, there may be severely degraded carrier deposition. Whereas when it is more than 45 μm, carrier deposition occurs more hardly but toner is not attached to a latent electrostatic image with fidelity, so that dot sizes are greatly varied to potentially lead to degradation in granularity (increase in roughness). When the weight average particle diameter (Dw) of the carrier is 22 μm to 32 μm, a ratio of carrier particles the weight average particle diameter (Dw) of which is less than 20 μm is preferably 0% by mass to 7% by mass. Also, it is preferable that a ratio of carrier particles the weight average particle diameter (Dw) of which is less than 36 μm be 80% by mass to 100% by mass, and a ratio of carrier particles the weight average particle diameter (Dw) of which is less than 44 μm be 90% by mass to 100% by mass. It is advantageous for each ratio to fall within the above preferred range in that the carrier particles have a sharp particle size distribution and have variation reduced in magnetism. Furthermore, it is advantageous to employ a developing method of applying DC bias since carrier deposition can remarkably been improved. Notably, the particle size distribution of the carrier can be measured with a MICROTRACK particle size analyzer (model HRA9320-X100: product of Honewell Co.).

A bulk density of the carrier is not particularly limited and may be appropriately selected depending on the intended purpose, but is preferably 2.15 g/cm$^3$ to 2.70 g/cm$^3$, more preferably 2.25 g/cm$^3$ to 2.60 g/cm$^3$, considering carrier deposition. When the bulk density of the carrier is less than 2.15 g/cm$^3$, the carrier becomes porous or has larger surface irregularities. As a result, even when the magnetization (emu/ g) of the core particles at 1 kOe is high, the substantial magnetization per one particle is low, which is disadvantageous in terms of carrier deposition. When the bulk density is more than 2.70 g/cm$^3$, the core particles are easy to fuse together at elevated firing temperatures, potentially making it difficult to beat them. The bulk density can be measured according to the metal powder-apparent density test method (JIS-Z-2504). Specifically, carrier particles are allowed to freely flow through an orifice 2.5 mm in diameter to a 25-cm$^3$ stainless steel cylindrical vessel placed directly below the orifice until the carrier particles are overflown from the vessel. The carrier particles present above the upper surface of the vessel are removed and leveled once with a non-magnetic flat spatula along the upper surface of the vessel. Then, a mass of the carrier particles contained in the vessel is divided by the volume of the vessel; i.e., 25 cm$^3$, to thereby determine a mass of the carrier particles per 1 cm$^3$. The mass of the carrier particles per 1 cm$^3$ is defined as the bulk density of the carrier. When carrier particles hardly flow through the above orifice, an orifice 5 mm in diameter is used to allow the carrier particles to freely flow therethrough.

An electrical resistivity (log R) of the carrier is not particularly limited and may be appropriately selected depending on the intended purpose, but is preferably 11.0 Ω·cm to 17.0 Ω·cm, more preferably 11.5 Ω·cm to 16.5 Ω·cm. The carrier having an electrical resistivity (log R) of lower than 11.0 Ω·cm have induced charges when a developing gap (the closest distance between a photoconductor and a developing sleeve) is small, easily causing carrier deposition. The carrier having an electrical resistivity (log R) of higher than 17.0 Ω·cm shows strong edge effects, potentially leading to unfavorable phenomena that a solid image portion is reduced in image density and that carrier particles are charged by charges opposite to those of toner particles and easy to accumulate, tending to cause carrier deposition.

A method for adjusting the electrical resistivity (log R) of the carrier is not particularly limited and may be appropriately selected depending on the intended purpose. Examples thereof include: a method of adjusting the resistivity of a coating resin on the core particles; a method of adjusting the thickness of a coating resin on the core particles; and a method of adding electroconductive powder to a coating resin layer. The electroconductive powder is not particularly limited and may be appropriately selected depending on the intended purpose. Examples thereof include: electroconductive ZnO; metals (e.g., Al); metal oxides (e.g., cerium oxide, alumina, and $SiO_2$ and $TiO_2$ whose surfaces have been hydrophobized); $SnO_2$ prepared with various methods or doped with various elements; borides (e.g., $TiB_2$, $ZnB_2$ and $MoB_2$); silicon carbide; electroconductive polymers (e.g., polyacetylene, polyparaphenylene, poly(paraphenylene sulfide)polypyrrole and polyethylene); and carbon black (e.g., furnace black, acetylene black and channel black). The electroconductive powder can be added to a coating resin layer in the following manner. Specifically, the electroconductive powder is added to a solvent used for coating or to a solution of a coating resin. Then, it is uniformly dispersed with a disperser using media (e.g., a ball mill or a beads mill) or a stirrer equipped with a high-speed rotating blade. The resultant dispersion liquid for forming a coating layer is coated on core particles to form carrier particles. An average particle diameter of the electroconductive powder is not particularly limited and may be appropriately selected depending on the intended purpose, but is preferably 1 μm or less since it becomes easier to control an electrical resistance of the coating layer.

The magnetization of the carrier is not particularly limited and may be appropriately selected depending on the intended purpose so long as it is enough to form a magnetic brush. The magnetization of the carrier is preferably 40 emu/g to 100 emu/g, more preferably 50 emu/g to 90 emu/g, when a magnetic field of 1,000 Oersted (Oe) is applied to the carrier. When the magnetization thereof is lower than 40 emu/g, carrier deposition easily occurs. Whereas when it is higher than 100 emu/g, a magnetic brush forms more noticeable traces. Notably, the magnetization can be measured with a B-H tracer (BHU-60, product of Riken Denshi Co., Ltd.) in the following manner. Specifically, carrier core particles (1 g) are charged into a hollow-cylindrical cell, which is then set to the tracer. In this tracer, the first magnetic field is gradually increased to 3,000 Oersted (Oe) and then gradually decreased to 0 Oersted (Oe). Next, the second magnetic field, which is an opposite direction to the first magnetic field, is gradually increased to 3,000 Oersted (Oe) and then gradually decreased to 0 Oersted (Oe). In this state, the first magnetic field is applied to the particles again to give a B-H curve. The B-H curve is used to determine a magnetic moment at 1,000 Oersted (Oe). Basically, the magnetization of the carrier is determined depending on a magnetic material forming core particles.

(Process Cartridge)

A process cartridge is used for the image forming apparatus of the present invention. The process cartridge includes a latent electrostatic image bearing member (electrophotographic photoconductor) and at least one unit selected from a charging unit, an exposing unit, a developing unit, a transfer unit, a cleaning unit and a charge-eliminating unit, can be detachably attached to the image forming apparatus of the present invention, and uses the toner of the present invention.

(Image Forming Method and Image Forming Apparatus)

An image forming apparatus of the present invention includes at least a latent electrostatic image bearing member (electrophotographic photoconductor), a latent electrostatic image forming unit, a developing unit and a transfer unit; and, if necessary, includes other units. The toner of the present invention is used in the developing unit. Notably, the latent electrostatic image forming unit is a combination of a charging unit and an exposing unit.

An image forming method includes a latent electrostatic image forming step, a developing step and a transfer step; and, if necessary, includes other steps. The toner of the present invention is used in the developing step. Notably, the latent electrostatic image forming step is a combination of a charging step and an exposing step.

<Latent Electrostatic Image Forming Step and Latent Electrostatic Image Forming Unit>

The latent electrostatic image forming step is a step of forming a latent electrostatic image on the latent electrostatic image bearing member, and is performed using the latent electrostatic image forming unit. In the latent electrostatic image bearing member, for example, its material, shape, structure or size is not particularly limited and may be appropriately selected depending on the intended purpose. Examples of the material include inorganic materials such as amorphous silicon or selenium; and organic materials such as polysilane or phthalopolymethine. Among them, amorphous silicon is preferably used from the viewpoint from attaining a long service life. Suitable example of the shape includes a drum shape.

The latent electrostatic image forming unit is a combination unit of a charging unit and an exposing unit. The charging unit is not particularly limited and may be appropriately selected depending on the intended purpose. Examples thereof include contact-type chargers known per se having, for example, an electroconductive or semielectroconductive roller, brush, film and rubber blade; and non-contact-type chargers utilizing colona discharge such as corotron or scorotron. The exposing unit is not particularly limited and may be appropriately selected depending on the intended purpose. Examples of the exposing unit include various exposing units such as a copy optical exposing unit, a rod lens array exposing unit, a laser optical exposing unit, a liquid crystal shutter exposing unit, and an LED optical exposing unit. Examples of a light source used for the exposing unit include those capable of securing high luminance, such as a light-emitting diode (LED), a laser diode (LD) and an electroluminescence (EL) device.

<Developing Step and Developing Unit>

The developing step can be performed using the developing unit and is a step of developing the latent electrostatic image with a toner to thereby form a visible image.

The developing unit is not particularly limited and may be appropriately selected depending on the intended purpose. For example, the developing unit is not particularly limited and may be appropriately selected depending on the intended purpose, so long as it can perform a development using the toner and the developer of the present invention. Suitable example of the developing unit includes those having at least a developing device which contains the developer therein and can apply the developer to the latent electrostatic image in a contact or non-contact manner. The developing device may employ a dry or wet developing process, and may be a single-color or multi-color developing device. Suitable example of the developing device includes those having a rotatable magnetic roller and a stirrer configured to charge the developer with friction stirring. In the developing device, the toner of the present invention are stirred and mixed with the carrier, so that the toner is charged by friction generated therebetween. The charged toner is retained in a chain-like form on a surface of the rotating magnetic roller to thereby form a magnetic brush. The magnetic roller is disposed proximately to the electrophotographic photoconductor. Accordingly, some of the toner of the present invention which constitutes the magnetic brush formed on the surface of the magnet roller are transferred onto a surface of the electrophotographic photoconductor by the action of electrically attractive force. As a result, the latent electrostatic image is developed with the toner to thereby form a visual toner image on the surface of the electrophotographic photoconductor.

<Transfer Step and Transfer Unit>

The transfer step can be performed using the transfer unit, and is a step of transferring the visible image onto a recording medium.

The transfer unit is a unit configured to transfer the visible image onto a recording medium. Examples of a method for transferring the visible image onto the recording medium include a method in which the visible image is directly transferred from a surface of the electrophotographic photoconductor to the recording medium and a method in which the visible image is primarily transferred to an intermediate transfer member and then secondarily transferred to the recording medium. The latter method is preferred. At this step, usually two or more color toners are used, and preferably full-color toner is used. Accordingly, the transfer step more preferably includes a primary transfer step of transferring visible images onto an intermediate transfer medium to form a composite transfer image, and a secondary transfer step of transferring the composite transfer image onto a recording medium.

<Fixing Step and Fixing Unit>

The fixing step is performed using the fixing unit, and is a step of fixing a transfer image which has been transferred onto the recording medium.

The fixing unit is not particularly limited and may be appropriately selected depending on the intended purpose, but preferably is a known heating-pressing unit. Examples of the heating-pressing unit include: a combination of a heating roller and a pressing roller; and a combination of a heating roller, a pressing roller and an endless belt. Usually, the heating by the heating-pressing unit is preferably performed at 80° C. to 200° C. The fixing may be performed every after a toner image of each color is transferred onto the recording medium; or the fixing may be performed at one time after toner images of all colors are superposed on top of one another on the recording medium.

<Other Steps and Other Units>

The other steps and the other units are not particularly limited and may be appropriately selected depending on the intended purpose. Examples thereof include: a charge-eliminating step and a charge-eliminating unit; a cleaning step and a cleaning unit; a recycling step and a recycling unit; and a controlling step and a controlling unit.

—Charge-Eliminating Step and Charge-Eliminating Unit—

The charge-eliminating step can be performed using the charge-eliminating unit and is a step of applying charge-eliminating bias to the electrophotographic photoconductor to thereby charge-eliminate the electrophotographic photoconductor. The charge-eliminating unit is not particularly limited and may be appropriately selected from known charge-eliminating devices, so long as it can apply charge-eliminating bias to the electrophotographic photoconductor. Example thereof includes a charge-eliminating lamp.

—Cleaning Step and Cleaning Unit—

The cleaning step can be performed using the cleaning unit, and is a step of removing the toner remaining on the electrophotographic photoconductor. The cleaning unit is not particularly limited and may be appropriately selected from known cleaners, so long as it can remove the toner remaining on the electrophotographic photoconductor. Examples thereof include magnetic blush cleaners, electrostatic brush cleaners, magnetic roller cleaners, blade cleaners, brush cleaners and web cleaners.

—Recycling Step and Recycling Unit—

The recycling step can be performed using the recycling unit, and is a step of recycling the toner removed in the cleaning step to the developing unit. The recycling unit is not particularly limited. Examples thereof include known conveyance units.

—Controlling Step and Controlling Unit—

The controlling step can be performed using the controlling unit, and is a step of controlling each of the above steps. The controlling unit is not particularly limited and may be appropriately selected depending on the purpose, so long as it can control the operation of each of the above units. Examples thereof include devices such as a sequencer and a computer.

[Embodiments of Image Forming Apparatus]

Next will be described embodiments of the image forming apparatus of the present invention.

FIG. 1 illustrates one exemplary image forming apparatus used in the present invention. An image forming apparatus 100A includes a photoconductor drum 10 serving as the image bearing member, a charging device 20 serving as the charging unit, an exposing device 30 serving as the exposing unit, a developing device 40 serving as the developing unit, an intermediate transfer member 50, a cleaning device 60 serving as the cleaning unit, and a charge-eliminating lamp 70 serving as the charge-eliminating unit.

The intermediate transfer member 50 shown in FIG. 1 is an endless belt and is extended over three rollers 51 so as to be driven in a direction indicated by an arrow. Some of the three rollers 51 serve also as a transfer bias roller which is capable of applying a predetermined transfer bias (primary transfer bias) to the intermediate transfer member 50. A cleaning device 90 having a cleaning blade is disposed in the vicinity of the intermediate transfer member 50. Also, a transfer roller 80 is disposed so as to face the intermediate transfer member 50 and serves as a transfer unit which is capable of applying a transfer bias for transferring (secondarily transferring) a visible image (toner image) onto a recording medium 95. Around the intermediate transfer member 50, a corona charger 58 for applying charges to the toner image on the intermediate transfer member 50 is disposed between a contact portion of the photoconductor 10 with the intermediate transfer member 50 and a contact portion of the intermediate transfer member 50 with the recording medium (transfer paper) 95 in a rotating direction of the intermediate transfer member 50.

The developing device 40 shown in FIG. 1 includes a developing belt 41 serving as a developer bearing member; and a black developing device 45K, a yellow developing device 45Y, a magenta developing device 45M and a cyan developing device 45C, these devices being arranged in a row around the developing belt 41. The black developing device 45K includes a developer accommodating section 42K, a developer supplying roller 43K, and a developing roller 44K. The yellow developing device 45Y includes a developer accommodating section 42Y, a developer supplying roller 43Y, and a developing roller 44Y. The magenta developing device 45M includes a developer accommodating section 42M, a developer supplying roller 43M, and a developing roller 44M. The cyan developing device 45C includes a developer accommodating section 42C, a developer supplying roller 43C, and a developing roller 44C. The developing belt 41 is an endless belt and is extended over a plurality of belt rollers so as to be capable of being driven in a direction indicated by an arrow, a part of which are in contact with the photoconductor 10.

In the image forming apparatus 100A shown in FIG. 1, the charging device 20 uniformly charges the photoconductor 10. And then, the photoconductor 10 is exposed by the exposing device 30 to thereby form a latent electrostatic image. Next, the latent electrostatic image formed on the photoconductor 10 is developed with a toner supplied from the developing device 40 to thereby form a toner image. The toner image is transferred (primary transferred) onto the intermediate transferring member 50 with a voltage applied by the rollers 51. The thus-transferred image is transferred (secondary transferred) onto the recording paper 95. As a result, the transfer image is formed on the recording paper 95. Notably, the toner remaining on the photoconductor 10 are removed by the cleaning device 60 having a cleaning blade, and charges on the photoconductor 10 are removed by the charge-eliminating lamp 70.

Figure 2:
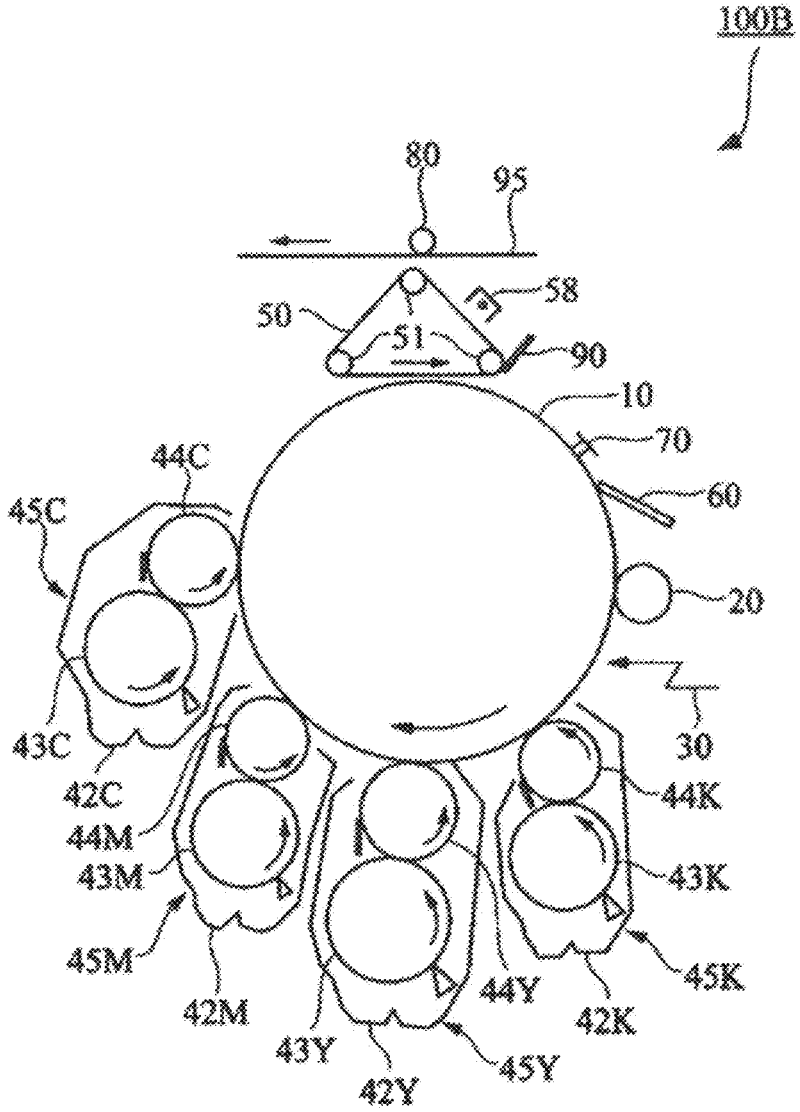
FIG. 2 is an explanatory, schematic view of another example of an image forming apparatus of the present invention.

FIG. 2 illustrates another exemplary image forming apparatus used in the present invention. The image forming apparatus 100B has the same configuration and the same function as the image forming apparatus 100A, except that there is no developing belt 41; and a black developing device 45K, a yellow developing device 45Y, a magenta developing device 45M and a cyan developing device 45C are arranged around the photoconductor 10. Note that common members to both in FIGS. 1 and 2 are indicated by the same reference numerals.

Figure 3:
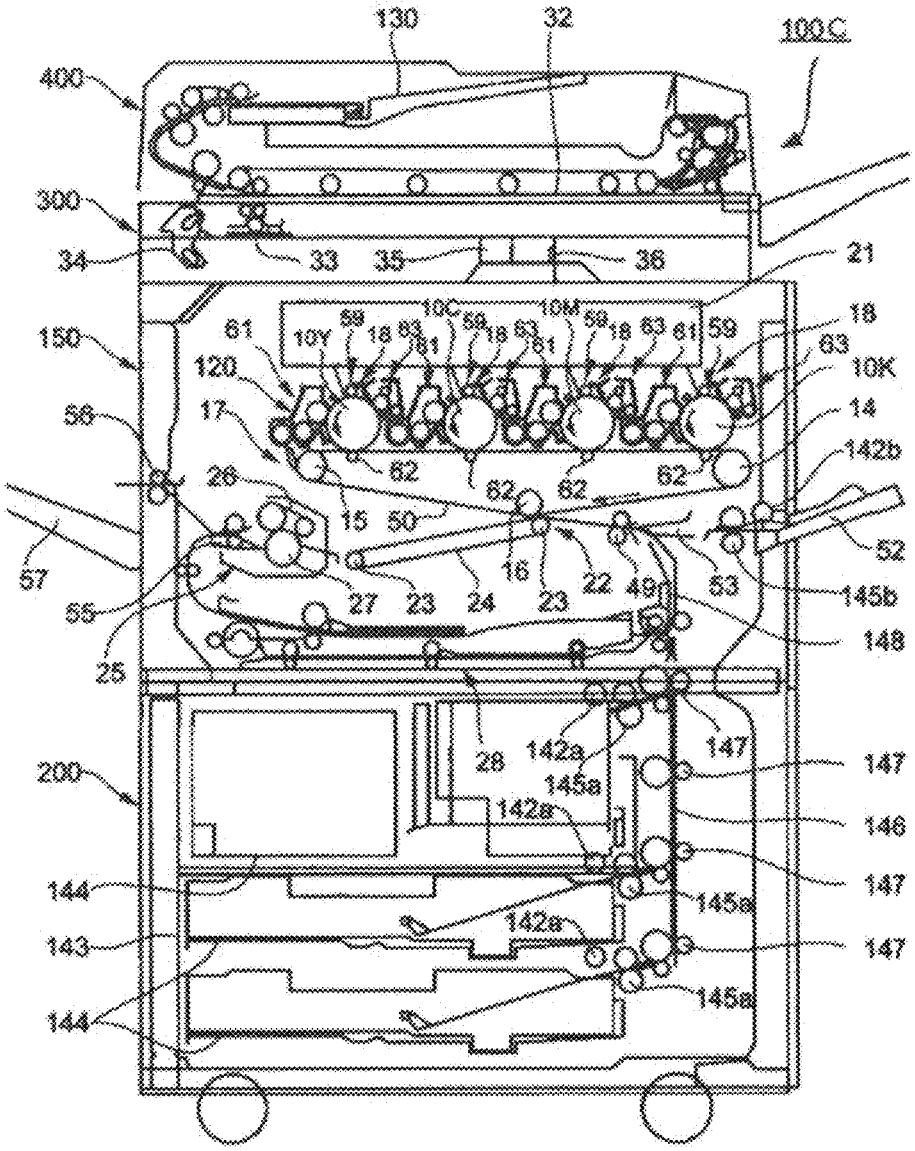
FIG. 3 is an explanatory, schematic view of a still another example of an image forming apparatus of the present invention.

FIG. 3 illustrates another exemplary image forming apparatus used in the present invention. An image forming apparatus 100C is a tandem color image forming apparatus. The image forming apparatus 100C includes a copying device main body 150, a paper feeding table 200, a scanner 300 and an automatic document feeder 400. The copying device main body 150 is provided at its center portion with an endless belt-shaped intermediate transferring member 50. In this figure, the intermediate transfer member 50 is extended over supporting rollers 14, and 16 so as to be capable of clockwise rotating. An intermediate transfer member-cleaning device 17 for removing the toner remaining on the intermediate transfer member 50 is disposed in the vicinity of the supporting roller 15. Around the intermediate transfer member 50 which is extended over the supporting rollers 14 and 15 is provided a tandem developing device 120 in which four image forming units 18 for yellow toner, cyan toner, magenta toner and black toner are arranged in a row along a moving direction of the intermediate transfer member. An exposing device 21 is provided in the vicinity of the tandem developing device 120. A secondary transfer device 22 is provided on the intermediate transfer member 50 on the side opposite to the side on which the tandem developing device 120 is disposed. In the secondary transfer device 22, an endless belt-shaped secondary transfer belt 24 is extended over a pair of supporting rollers 23. A recording paper which is conveyed on the secondary transfer belt 24 can come into contact with the intermediate transfer member 50. A fixing device 25 is provided in the vicinity of the secondary transfer device 22. The fixing device 25 includes an endless fixing belt 26 and a pressing roller 27 disposed so as to be pressed against the fixing belt 26. Notably, in the image forming apparatus 100C, a sheet reversing device 28 for reversing the transfer paper is disposed in the vicinity of the secondary transfer device 22 and the fixing device 25. The sheet reversing device allows images to be formed on both sides of the recording paper.

Figure 4:
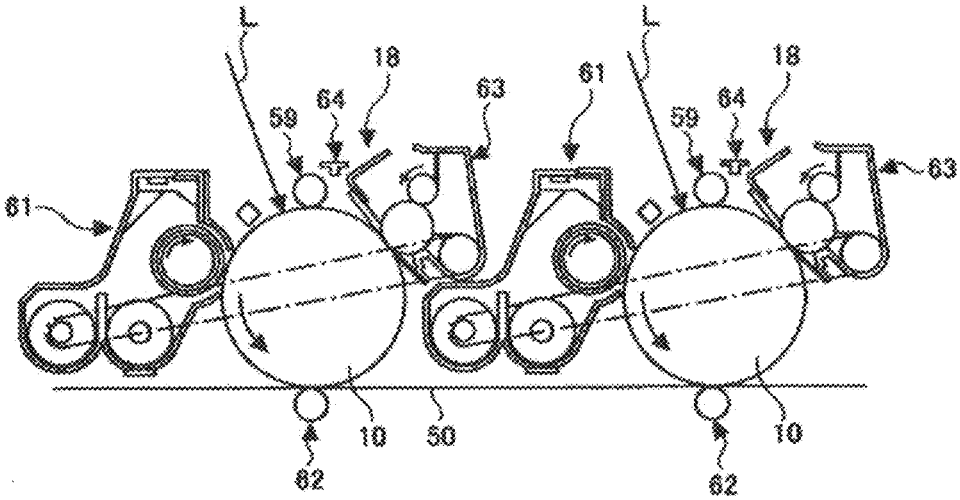
FIG. 4 is an explanatory, schematic view of a part of the image forming apparatus illustrated in FIG. 3.

FIG. 4 illustrates formation of a full color image (color copy) using the tandem developing device 120 as another exemplary image forming apparatus used in the present invention. Each of the image forming units 18 in the tandem developing device 120 includes a photoconductor 10; a charger 59 for uniformly charging the photoconductor 10; an exposing device 21 for exposing the photoconductor 10 to light (indicated by a symbol L in FIG. 6) based on image information corresponding to black, yellow, magenta and cyan to thereby form a latent electrostatic image corresponding to each of black, yellow, magenta and cyan on the photoconductor 10; a developing device 61 for developing the latent electrostatic image with each color toner to thereby form each color toner image on the photoconductor 10; a transfer charger 62 for transferring the color toner image onto the intermediate transfer member 50; a cleaning device 63 for photoconductor; and a charge-eliminating device 64.

In the tandem developing device 120 shown in FIG. 4, firstly, an original document is set on a document table 130 of an automatic document feeder 400. Alternatively, the automatic document feeder 400 is opened and then an original document is set on a contact glass 32 of the scanner 300, followed by closing the automatic document feeder 400. In the former case, when a starting switch (not illustrated) is pressed, the scanner 300 is operated to run a first carriage 33 and a second carriage 34 after the original document has been conveyed onto the contact glass 32. In the latter case, when a starting switch (not illustrated) is pressed, the scanner 300 is operated to run a first carriage 33 and a second carriage 34 immediately after the original document has been set on the contact glass 32. At that time, the first carriage 33 irradiates light to the original document, and then the second carriage 34 reflects, on its mirror, light reflected by the original document. The thus-reflected light is received by a reading sensor 36 through an imaging lens 35. Thus, the original document (color image) is read to thereby form image information corresponding to black, yellow, magenta and cyan. The image information is transferred to a corresponding image forming unit 18 in the tandem developing device 120 to thereby form a toner image of each of black, yellow, magenta and cyan. A black image formed on the black photoconductor 10K, a yellow image formed on the yellow photoconductor 10Y, a magenta image formed on the magenta photoconductor 10M, and a cyan image formed on the cyan photoconductor 10C are sequentially transferred (primarily transferred) onto the intermediate transfer member 50. Then, the black, yellow, magenta and cyan images are superposed on the intermediate transfer member 50 to thereby form a composite color image (transferred color image).

In a paper feeding table 200, one of paper feeding rollers 142*a* is selectively rotated to thereby feed recording paper from one of vertically stacked paper feeding cassettes 144 housed in a paper bank 143. The thus-fed sheets of paper are separated one another by a separating roller 145*a*. The thus-separated sheet is fed through a paper feeding path 146, then fed through a paper feeding path 148 in a copying device main body 150 by a transfer roller 147, and stopped at a resist roller 49. Alternatively, paper feeding rollers 142*b* are rotated to thereby feed recording paper placed on a manual-feeding tray 52. The thus-fed sheets of paper are separated one another by a separating roller 145*b*. The thus-separated sheet is fed through a manual paper-feeding path 53 and then stopped at a resist roller 49 similar to the above. Notably, the resist roller 49 is generally connected to the ground in use. Alternatively, the resist roller 49 may be used with being applied by a bias for removing paper dust from the sheet. The resist roller 49 is rotated to thereby feed recording paper to between the intermediate transfer member 50 and the secondary transfer device 22 in synchronization with the transferred color image formed on the intermediate transfer member 50, whereby the transferred color image is formed on the recording paper. The recording paper having the transferred color image is fed by the secondary transfer device 22 to a fixing device 25. The fixing device 25 fixes the transferred color image on the recording paper through application of heat and pressure. Subsequently, the recording paper is discharged from a discharge roller 56 by a switching claw 55 and then stacked on a discharge tray 57. Alternatively, the recording paper is switched by a switching claw 55 and reversed by a sheet reversing device 28. The reversed paper is fed again to the transfer position where an image is transferred on the back surface of the paper. The paper is discharged from a discharge roller 56 and then stacked on a discharge tray 57. Notably, the toner remaining on the intermediate transfer member 50 after image transfer is removed by an intermediate transfer member-cleaning device 17.

EXAMPLES

The present invention now will be described in detail by way of Examples and Comparative Examples, which should not be construed as limiting the present invention thereto. Unless otherwise specified, in Examples, the unit "part(s)" means "part(s) by mass" and the unit "%" means "% by mass."

(Production of External Additive)

—Production of Non-Spherical Particles A to M, O, and Q to R—

Non-spherical particles were produced as follows. Specifically, primary particles having various average particle diameters described in Table 2 and a treatment agent (hexamethyldisiloxane (HMDS), product of Wako Pure Chemical Industries, Ltd.) were mixed together using a spray dryer (trade name: CBK39, product of PRECI Co., Ltd.), followed by firing under the conditions presented in Table 1 so that the primary particles were coalesced with each other.

Non-spherical particles J and O were produced by subjecting primary particles having various average particle diameters described in Table 2 to a hydrophobic treatment using the above treatment agent (hexamethyldisiloxane (HMDS), product of Wako Pure Chemical Industries, Ltd.). Table 1 presents average particle diameters, shapes and other properties of the secondary particles (coalesced particles) produced by coalescing the primary particles with each other.

—Production of Spherical Particles P—

Methanol (693.0 g), water (46.0 g) and 28% aqueous ammonia (55.3 g) were added to a 3 L glass reactor equipped with a stirrer, a dropping funnel and a thermometer, followed by mixing. The resultant solution was adjusted in temperature to 50° C., and additions of tetramethoxysilane (1293.0 g; 8.5 mol) and 5.4% aqueous ammonia (464.5 g) were started at the same time under stirring. Here, tetramethoxysilane was added dropwise thereto for 6 hours and 5.4% aqueous ammonia was added dropwise thereto for 4 hours. After completion of the addition of tetramethoxysilane, the mixture was stirred for 0.5 hours to perform hydrolysis, to thereby obtain a suspension of silica particles. Hexamethyldisilazane (547.4 g; 3.39 mol) was added to the obtained suspension at room temperature and heated at 120° C. for reaction for 3 hours so that the silica was trimethylsilylated. After that, the solvent was removed under reduced pressure to thereby obtain [spherical particles P] (553.0 g).

—Production of Spherical Particles A to D and F—

Spherical particles A to D and F used were commercially available products presented in Table 3.

(Various Measurements of External Additives)

—Measurement of Degree of Coalescence of Coalesced Particles—

The average of degrees of coalescence of the obtained non-spherical particles (i.e., the particle diameter of each of the secondary particles/the average particle diameter of the primary particles) was determined based on the particle diameters of the primary and secondary particles measured in the following manner.

The average particle diameter of the primary particles was measured as follows. Specifically, the primary particles were dispersed in a solvent (THF). The resultant dispersion liquid was subjected to solvent removal to dryness on a substrate to thereby obtain a measurement sample. The measurement sample was observed under a field emission type scanning electron microscope (FE-SEM, acceleration voltage: 5 kV to 8 kV, observed magnification: 8,000 to 10,000), and measured for an average particle diameter of the primary particles within a field of vision (i.e., an average of the longest particle diameters of the primary particles aggregated (the lengths of all the arrows in FIG. 5). Here, the number of the primary particles measured was 100.

The average particle diameter of the secondary particles was measured as follows. Specifically, the secondary particles were dispersed in a solvent (THF). The resultant dispersion liquid was subjected to solvent removal to dryness on a substrate to thereby obtain a measurement sample. The measurement sample was observed under a field emission type scanning electron microscope (FE-SEM, acceleration voltage: 5 kV to 8 kV, observed magnification: 8,000 to 10,000), and measured for an average particle diameter of the non-spherical particles within a field of vision (i.e., an average of the longest particle diameters of the whole images predicted from the profiles of the coalesced non-spherical particles (the length of the arrow in FIG. 6). Here, the number of the secondary particles measured was 100.

—Measurement of Amount of Carbon—

An amount of carbon derived from an alkoxy group remaining in the obtained non-spherical particles was measured as follows. Specifically, 0.1 g of a sample was accurately weighed on a magnetic board. The magnetic board was placed in a burning furnace, followed by burning at about 1,200° C. An amount of $CO_2$ generated during burning was converted to obtain the above amount of carbon.

—Measurement of Amount of Water—

A ratio of water remaining in the obtained non-spherical particles was measured by the dead-stop end-point method using a Karl Fischer titrator; a water content meter of a volumetric titration type (model KF-06, product of Mitsubishi Chemical Corporation). First, 10 μL of pure water was accurately weighed with a microsyringe, and a titration amount of a reagent necessary for removing the water was measured. The obtained value was converted to obtain an amount of water (mg) per 1 mL of a Karl Fischer reagent. Next, 100 mg to 200 mg of a measurement sample was accurately weighed and thoroughly dispersed in a measurement flask with a magnetic stirrer for 5 min. After dispersion, measurement of the sample was started to obtain a total titration amount (mL) of the Karl Fischer reagent necessary for titration, which was used to calculate the ratio of water from the following equations.

$$\text{Ratio of water}(\%)=\text{amount of water}(mg)/\text{amount of sample}(mg)\times 100$$

$$\text{Amount of water}(mg)=\text{amount of reagent consumed}(mL)\times\text{titer of reagent}(mgH_2O/mL)$$

TABLE 3

| | External additive | | | | |
|---|---|---|---|---|---|
| | Type | Production method | Avg. particle diameter (nm) | Trade name | Manufacturer |
| Spherical particles A | Silica | Dry method | 23 | H1303 | Clariant Japan K.K. |
| Spherical particles B | Silica | Dry method | 30 | NX90G | Aerosil Co., Ltd. |
| Spherical particles C | Silica | Dry method | 19 | H2000 | Clariant Japan K.K. |
| Spherical particles F | Silica | Dry method | 12 | RX200 | Aerosil Co., Ltd. |
| Spherical particles D | Silica | Dry method | 7 | RX300 | Aerosil Co., Ltd. |

Synthesis Example 1

Synthesis of Unmodified Polyester Resin (Non-Crystalline Polyester Resin)

A 5 L four-neck flask equipped with a nitrogen-introducing pipe, a drainpipe, a stirrer and a thermocouple was charged with bisphenol A ethylene oxide 2 mole adduct (229 parts), bisphenol A propylene oxide 3 mole adduct (529 parts), terephthalic acid (208 parts), adipic acid (46 parts) and dibutyltin oxide (2 parts). The reaction mixture was allowed to react under a normal pressure at 230° C. for 7 hours and further react under a reduced pressure of 10 mmHg to 15 mmHg for 4 hours. Then, trimellitic anhydride (44 parts) was added to the flask, followed by reaction at 180° C. under a normal pressure for 2 hours, to thereby obtain [unmodified polyester 1].

Synthesis Example 2

Synthesis of Polyester Prepolymer

A reaction container equipped with a condenser, a stirrer and a nitrogen-introducing pipe was charged with bisphenol

TABLE 2

| | External additive | | | | | | |
|---|---|---|---|---|---|---|---|
| | Production conditions | | | | Properties | | |
| | Type | Avg. particle diameter of primary particles (nm) | Avg. particle diameter of secondary particles (nm) | Production method | Average of degrees of coalescence | Amount of carbon (%) | Amount of water (%) |
| Non-spherical particles A | Silica | 59.3 | 160 | Sol-gel method | 2.7 | 0.8 | 0.7 |
| Non-spherical particles B | Silica | 57.9 | 110 | Sol-gel method | 1.9 | 0.8 | 0.9 |
| Non-spherical particles C | Silica | 26.9 | 105 | Sol-gel method | 3.9 | 0.7 | 0.9 |
| Non-spherical particles D | Silica | 48.6 | 180 | Sol-gel method | 3.7 | 0.6 | 0.8 |
| Non-spherical particles E | Silica | 100.0 | 180 | Sol-gel method | 1.8 | 0.8 | 0.7 |
| Non-spherical particles F | Silica | 59.3 | 160 | Sol-gel method | 2.7 | 4.5 | 0.9 |
| Non-spherical particles G | Silica | 59.3 | 160 | Sol-gel method | 2.7 | 1.2 | 0.9 |
| Non-spherical particles H | Silica | 59.3 | 160 | Sol-gel method | 2.7 | 0.8 | 3.0 |
| Non-spherical particles I | Silica | 59.3 | 160 | Sol-gel method | 2.7 | 0.8 | 1.5 |
| Non-spherical particles Q | Silica | 33.3 | 60 | Sol-gel method | 1.8 | 0.7 | 0.8 |
| Non-spherical particles R | Silica | 177.8 | 480 | Sol-gel method | 2.7 | 0.7 | 0.7 |
| Non-spherical particles J | Silica | 59.3 | 160 | Dry method | 2.7 | 0.8 | 0.2 |
| Non-spherical particles K | Silica | 71.9 | 115 | Sol-gel method | 1.6 | 0.6 | 0.8 |
| Non-spherical particles L | Silica | 29.4 | 50 | Sol-gel method | 1.7 | 0.8 | 0.9 |
| Non-spherical particles M | Silica | 47.6 | 195 | Sol-gel method | 4.1 | 0.6 | 0.9 |
| Non-spherical particles O | Silica | 120.0 | 200 | Sol-gel method | 1.0 | 0.9 | 0.9 |
| Spherical particles P | Silica | 30 | — | Sol-gel method | 1.0 | 0.8 | 0.7 |

A ethylene oxide 2 mole adduct (682 parts), bisphenol A propylene oxide 2 mole adduct (81 parts), terephthalic acid (283 parts), trimellitic anhydride (22 parts) and dibutyltin oxide (2 parts). The resultant mixture was allowed to react under a normal pressure at 230° C. for 8 hours and further react at a reduced pressure of 10 mmHg to 15 mmHg for 5 hours, to thereby obtain [intermediate polyester 1].

Next, a reaction container equipped with a condenser, a stirrer and a nitrogen-introducing pipe was charged with [intermediate polyester 1] (410 parts), isophorone diisocyanate (89 parts) and ethyl acetate (500 parts), followed by reaction at 100° C. for 5 hours, to thereby produce [polyester prepolymer 1].

Synthesis Example 3

Synthesis of Ketimine

A reaction container equipped with a stirring rod and a thermometer was charged with isophorone diamine (170 parts) and methyl ethyl ketone (75 parts), followed by reaction at 50° C. for 5 hours, to thereby obtain [ketimine compound 1].

Synthesis Example 4

Synthesis of Masterbatch (MB)

Water (1,200 parts), carbon black (PRINTEX 35, product of Evonik Degussa Japan Co., Ltd.) [DBP oil absorption amount=42 mL/100 mg, pH=9.5] (540 parts) and [unmodified polyester 1] (1,200 parts) were mixed together using HENSCHEL MIXER (product of NIPPON COKE & ENGINEERING COMPANY, LIMITED.) The resultant mixture was kneaded at 150° C. for 30 min using a two-roller mill, and then rolled, cooled and pulverized with a pulverizer, to thereby prepare [masterbatch 1].

Synthesis Example 5

Preparation of Particle Dispersion Liquid

A reaction container equipped with a stirring rod and a thermometer was charged with water (683 parts), a sodium salt of methacrylic acid ethylene oxide adduct sulfate ester (ELEMINOL RS-30, product of Sanyo Chemical Industries Ltd.) (11 parts), styrene (138 parts), methacrylic acid (138 parts) and ammonium persulphate (1 part). The resultant mixture was stirred at 400 rpm for 15 min to thereby obtain a white emulsion. The reaction system was heated to a temperature of 75° C., followed by reaction for 5 hours. In addition, 1% aqueous solution of ammonium persulfate (30 parts) was added to the container. The resultant mixture was aged at 75° C. for 5 hours, to thereby obtain [particle dispersion liquid 1], which was an aqueous dispersion liquid of vinyl-based resin (copolymer of styrene, methacrylic acid, and a sodium salt of methacrylic acid ethylene oxide adduct sulfate ester).

Example 1

<Production of Toner>

<<Oil Phase Preparation Step>>

A container equipped with a stirring rod and a thermometer was charged with [unmodified polyester 1] (378 parts), carnauba wax (110 parts), a charge controlling agent (CCA, salicylic acid metal complex E-84: product of Orient Chemical Industries, Ltd.) (22 parts) and ethyl acetate (947 parts). The resultant mixture was heated to 80° C. under stirring, maintained at 80° C. for 5 hours and then cooled to 30° C. for 1 hour. Subsequently, [masterbatch 1] (500 parts) and ethyl acetate (500 parts) were charged into the container, followed by mixing for 1 hour, to thereby obtain [raw material solution 1]. [Raw material solution 1] (1,324 parts) was placed in a container. Carbon black and wax were dispersed using a beads mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed in 80% by volume, and 3 passes. Next, a 65% by mass ethyl acetate solution of the [unmodified polyester 1] (1,042.3 parts) was added thereto, and passed once through the beads mill under the above conditions, to thereby obtain [pigment-WAX dispersion liquid 1].

<<Aqueous Phase Preparation Step>>

Water (990 parts), [particle dispersion liquid 1] (83 parts), a 48.5% aqueous solution of sodium dodecyldiphenyl ether disulfonate (ELEMINOL MON-7, product of Sanyo Chemical Industries Ltd.) (37 parts) and ethyl acetate (90 parts) were mixed together and stirred to obtain an [aqueous phase 1] which was an opaque white liquid.

<<Emulsification and Dispersion Step>>

[Pigment-WAX dispersion liquid 1] (664 parts), [polyester prepolymer 1] (109.4 parts), [unmodified polyester 1] (73.9 parts), and [ketimine compound 1] (4.6 parts) were placed in a container, followed by mixing for 1 min at 5,000 rpm using TK HOMOMIXER (product of PRIMIX Corporation). Thereafter, [aqueous phase 1] (1,200 parts) was added to the container, and the resultant mixture was mixed using TK HOMOMIXER at 13,000 rpm for 20 min, to thereby obtain [emulsified slurry 1].

<<Solvent Removal Step>>

A container equipped with a stirrer and a thermometer was charged with [emulsified slurry 1], followed by desolvation at 30° C. for 8 hours and aging at 45° C. for 4 hours, to thereby obtain [dispersion slurry 1].

<<Washing and Drying Step>>

[Dispersion slurry 1] (100 parts) was filtrated under a reduced pressure and then subjected to a series of treatments (1) to (4) described below:

(1): ion-exchanged water (100 parts) was added to a filtration cake, followed by mixing using TK HOMOMIXER (at 12,000 rpm for 10 min) and then filtration;

(2): 10% aqueous solution of sodium hydroxide (100 parts) was added to the filtration cake obtained in (1), followed by mixing using TK HOMOMIXER (at 12,000 rpm for 30 min) and then filtration under a reduced pressure;

(3): 10% hydrochloric acid (100 parts) was added to the filtration cake obtained in (2), followed by mixing using TK HOMOMIXER (at 12,000 rpm for 10 min) and then filtration; and (4): ion-exchanged water (300 parts) was added to the filtration cake obtained in (3), followed by mixing using TK HOMOMIXER (at 12,000 rpm for 10 min) and then filtration.

A series of the treatments (1) to (4) was performed twice to thereby obtain [filtration cake 1]. [Filtration cake 1] was dried using an air-circulating drier at 45° C. for 48 hours, and then was caused to pass through a sieve with a mesh size of 75 μm, to thereby obtain [toner base particles 1]. The obtained toner base particles were found to have an average particle diameter of 5.2 μm.

<<External Additive Treatment Step>>

(1) [Toner base particles 1] (100 parts) and [non-spherical particles A] (2.35 parts) were charged into and mixed together in HENSCHEL MIXER (product of NIPPON COKE & ENGINEERING CO., LTD.) whose circumferential speed and mixing time were set to 40 m/s and 2 min, respectively, to thereby obtain [toner intermediate 1].

(2) [Toner intermediate 1] (100 parts) and titanium oxide having an average particle diameter of 20 nm (MT-1501B, product of Tayca Corporation) (0.6 parts) were charged into and mixed together in HENSCHEL MIXER whose circumferential speed and mixing time were set to 40 m/s and 2 min, respectively, to thereby obtain [toner intermediate 2].

(3) [Toner intermediate 2] (100 parts) and [spherical particles A] (1.79 parts) were charged into and mixed together in HENSCHEL MIXER whose circumferential speed and mixing time were set to 40 m/s and 2 min, followed by sieving with a 500 mesh sieve to thereby obtain [toner A].

<<Measurement of Dv/Dn>>

The obtained toner was measured for a ratio Dv/Dn of a volume average particle diameter (Dv) to a number average particle diameter (Dn). This measurement was performed using a particle size analyzer ("MULTISIZER III," product of Beckman Coulter Co.) with the aperture diameter being set to 100 μm, and the obtained measurements were analyzed with an analysis software (Beckman Coulter Multisizer 3 Version 3.51). Specifically, a 10% by mass surfactant (alkylbenzene sulfonate, NEOGEN SC-A, product of Daiichi Kogyo Seiyaku Co.) (0.5 mL) was added to a 100 mL-glass beaker, and a toner sample (0.5 g) was added thereto, followed by stirring with a microspartel. Subsequently, ion-exchange water (80 mL) was added to the beaker, and the obtained dispersion liquid was dispersed with an ultrasonic wave disperser (W-113MK-II, product of Honda Electronics Co.) for 10 min. The resultant dispersion liquid was measured using the above particle size analyzer and ISOTON III (product of Beckman Coulter Co.) serving as a solution for measurement. In this measurement, the dispersion liquid containing the toner sample was dropped so that the concentration indicated by the meter fell within a range of 8%±2%.

Example 2

[Toner B] was obtained in the same manner as in Example 1, except that in the external additive treatment step, [non-spherical particles A] (2.35 parts) was changed to [non-spherical particles B] (1.73 parts) and [spherical particles A] (1.79 parts) was changed to [spherical particles B] (2.11 parts).

Example 3

[Toner C] was obtained in the same manner as in Example 1, except that in the external additive treatment step, [non-spherical particles A] (2.35 parts) was changed to [non-spherical particles C] (1.65 parts) and [spherical particles A] (1.79 parts) was changed to [spherical particles C] (1.22 parts).

Example 4

[Toner D] was obtained in the same manner as in Example 1, except that in the external additive treatment step, [non-spherical particles A] (2.35 parts) was changed to [non-spherical particles D] (2.45 parts).

Example 5

[Toner E] was obtained in the same manner as in Example 1, except that in the external additive treatment step, [non-spherical particles A] (2.35 parts) was changed to [non-spherical particles E] (2.45 parts).

Example 6

[Toner F] was obtained in the same manner as in Example 1, except that in the external additive treatment step, [non-spherical particles A] (2.35 parts) was changed to [non-spherical particles F] (2.35 parts) and [spherical particles A] (1.79 parts) was changed to [spherical particles B] (2.11 parts).

Example 7

[Toner G] was obtained in the same manner as in Example 1, except that in the external additive treatment step, [non-spherical particles A] (2.35 parts) was changed to [non-spherical particles G] (2.35 parts) and [spherical particles A] (1.79 parts) was changed to [spherical particles B] (2.11 parts).

Example 8

[Toner H] was obtained in the same manner as in Example 1, except that in the external additive treatment step, [non-spherical particles A] (2.35 parts) was changed to [non-spherical particles H] (2.35 parts) and [spherical particles A] (1.79 parts) was changed to [spherical particles C] (1.22 parts).

Example 9

[Toner I] was obtained in the same manner as in Example 1, except that in the external additive treatment step, [non-spherical particles A] (2.35 parts) was changed to [non-spherical particles I] (2.35 parts) and [spherical particles A] (1.79 parts) was changed to [spherical particles C] (1.22 parts).

Example 10

[Toner A2] was obtained in the same manner as in Example 1, except that in the aqueous phase preparation step, the amount of the 48.5% aqueous solution of sodium dodecyldiphenyl ether disulfonate (ELEMINOL MON-7, product of Sanyo Chemical Industries Ltd.) was changed to 19 parts.

Example 11

[Toner A3] was obtained in the same manner as in Example 1, except that in the external additive treatment step, no titanium oxide was added.

Example 12

[Toner T] was obtained in the same manner as in Example 1, except that in the external additive treatment step, [spherical particles A] (1.79 parts) was changed to [spherical particles F] (0.94 parts).

Example 13

[Toner U] was obtained in the same manner as in Example 1, except that in the external additive treatment step, [non-spherical particles A] (2.35 parts) was changed to [non-spherical particles Q] (0.87 parts).

Example 14

[Toner V] was obtained in the same manner as in Example 1, except that in the external additive treatment step, [non-spherical particles A] (2.35 parts) was changed to [non-spherical particles R] (3.00 parts).

Example 15

[Toner J] was obtained in the same manner as in Example 1, except that in the external additive treatment step, [non-spherical particles A] (2.35 parts) was changed to [non-spherical particles J] (2.51 parts) produced by a dry method.

Example 16

[Toner K] was obtained in the same manner as in Example 1, except that in the external additive treatment step, [non-spherical particles A] (2.35 parts) was changed to [non-spherical particles K] (1.93 parts).

Example 17

[Toner L] was obtained in the same manner as in Example 1, except that in the external additive treatment step, [non-spherical particles A] (2.35 parts) was changed to [non-spherical particles L] (0.63 parts) and [spherical particles A] (1.79 parts) was changed to [spherical particles B] (2.11 parts).

Example 18

[Toner M] was obtained in the same manner as in Example 1, except that in the external additive treatment step, [non-spherical particles A] (2.35 parts) was changed to [non-spherical particles M] (2.25 parts) and [spherical particles A] (1.79 parts) was changed to [spherical particles B] (2.11 parts).

Example 19

[Toner Q] was obtained in the same manner as in Example 1, except that in the external additive treatment step, [spherical particles A] (1.79 parts) was changed to [spherical particles D] (0.54 parts).

Example 20

[Toner W] was obtained in the same manner as in Example 1, except that in the external additive treatment step, [non-spherical particles A] (2.35 parts) was changed to [non-spherical particles 0] (1.76 parts).

Comparative Example 1

[Toner O] was obtained in the same manner as in Example 1, except that in the external additive treatment step, the amount of [non-spherical particles A] was changed to 2.51 parts and [spherical particles A] (1.79 parts) was changed to [spherical particles C] (1.09 parts).

Comparative Example 2

[Toner P] was obtained in the same manner as in Example 1, except that in the external additive treatment step, the amount of [non-spherical particles A] was changed to 2.85 parts and [spherical particles A] (1.79 parts) was changed to [spherical particles C] (1.09 parts).

Comparative Example 3

[Toner S] was obtained in the same manner as in Example 1, except that in the external additive treatment step, [spherical particles A] (1.79 parts) was changed to [spherical particles P] (1.91 parts).

Comparative Example 4

[Toner T] was obtained in the same manner as in Example 1, except that in the external additive treatment step, the amount of [non-spherical particles A] was changed to 1.34 parts.

Comparative Example 5

[Toner U] was obtained in the same manner as in Example 1, except that in the external additive treatment step, the amount of [non-spherical particles A] was changed to 3.70 parts and the amount of [spherical particles A] was changed to 2.00 parts.

Comparative Example 6

[Toner V] was obtained in the same manner as in Example 1, except that in the external additive treatment step, [non-spherical particles A] (2.35 parts) was changed to [non-spherical particles C] (1.65 parts) and [spherical particles A] (1.79 parts) was changed to [spherical particles B] (1.46 parts).

Comparative Example 7

[Toner W] was obtained in the same manner as in Example 1, except that in the external additive treatment step, the amount of [spherical particles A] was changed to 2.15 parts.

(Production of Developer)

Each of the toners produced in Examples and Comparative Examples was mixed with a carrier so that the concentration of the toner was 7%, followed by stirring with a turbulator (trade name "TURBULA," product of WAB Co.), to thereby produce developers.

(Evaluation)

Table 4 presents properties of the toners produced in Examples and Comparative Examples. Table 5 presents evaluation results of the developers containing the toners produced in Examples and Comparative Examples.

The specific gravities of the toners produced in Examples and Comparative Examples and of the external additives were obtained by measuring their true specific gravities. The true specific gravities were measured as follows. Specifically, the volume of a sample was measured with a dry-process automated densitometer using a vapor-phase substitution method (ACCUPYC 1330, product of Shimadzu Corporation Ltd.) at a constant temperature (20° C.) with the volume and pressure of gas (He gas) being changed. Then, the mass of the sample was measured from the measured volume thereof, and the density of the sample was determined.

<Heat Resistance Storageability>

The toners were stored at 40° C. and 70% RH for 2 weeks. Subsequently, the toners were sieved with a 75 mesh sieve manually vibrated. Then, a rate of the toner remaining on the sieve (residual rate) was measured and evaluated according to the following evaluation criteria. The less the residual rate of the toner is, the better the heat resistance storageability is.

[Evaluation Criteria]

A: Residual rate=0%

B: 0%<Residual rate <1%

C: 1%≤Residual rate <2%

D: 2%≤Residual rate

<Transferability>

A chart with an image area ratio of 20% was transferred from a photoconductor to paper using an image forming apparatus (trade name "IMAGIO MP C6000," product of Ricoh Company, Ltd.). Thereafter, at a time point just before a cleaning step, the toner remaining on the photoconductor was transferred onto a blank paper sheet using a piece of scotch tape (product of Sumitomo 3M Ltd.). Thus transferred paper sheet was measured using a MACBETH reflective densitometer model RD514 and evaluated according to the following criteria.

[Evaluation criteria]

A: Difference from the blank <0.005

B: 0.005≤Difference from the blank ≤0.010

C: 0.010<Difference from the blank ≤0.020

D: 0.020<Difference from the blank

<Flowability>

The flowability was judged based on a degree of aggregation of each toner. The degree of aggregation of the toner is an indicator for adhesive force acting between toner particles. When the degree of aggregation of the toner is large, each toner particle cannot be separated from other toner particles due to large adhesive force therebetween; i.e., developability is degraded. The degree of aggregation of the toner was measured using a powder tester (product of Hosokawa Micron Co., Ltd.) in the following manner. Specifically, sieves 75 μm, 45 μm and 22 μm in opening were arranged from top to bottom, and 2 g of toner particles was applied to the sieve 75 μm in opening, followed by application of vibration with amplitude of 1 mm for 30 sec. Then, a mass of the toner particles present on each sieve after vibration was measured. Next, the mass of the toner particles present on the 75 μm sieve was multiplied by "0.5", the mass thereof on the 45 μm sieve was multiplied by "0.3" and the mass thereof on the 22 μm sieve was multiplied by "0.1," and the obtained values were added together, and further the resultant value was expressed as a percentage and evaluated according to the following criteria.

[Evaluation Criteria]

A: Degree of aggregation of toner <10%

B: 10%≤Degree of aggregation of toner ≤15%

C: 15%≤Degree of aggregation of toner ≤20%

D: 20%<Degree of aggregation of toner

<Filming Property>

An image forming apparatus (trade name "IMAGIO MP C6000," product of Ricoh Company, Ltd.) was used to print out 1,000 sheets each having a belt chart with an image area ratio of 100%, 1,000 sheets each having a belt chart with an image area ratio of 75% and 1,000 sheets each having a belt chart with an image area ratio of 50%. The developing roller and the photoconductor after printing were observed for filming and evaluated according to the following criteria.

[Evaluation Criteria]

A: No filming occurred.

B: Filming was slightly observed.

C: Streaky filming occurred.

D: Filming occurred on the entire surface.

<Charegeability>

After maintained in a normal temperature, normal humidity chamber (temperature: 23.5° C., humidity: 60% RH) for humidity conditioning in an open system for 30 min to 1 hour, a carrier (6.0 g) and a toner (0.452 g) in initial states were placed in a stainless steel container, followed by sealing. The stainless steel container was shaken at a frequency of about 1,100 for 1 min using a shaker (YS-LD, product of Yayoi Co., Ltd.) with the graduation being set to 150, to thereby produce a frictionally-charged sample. The thus-prepared sample was measured for charge amount with a blow-off method (TB-200, product of Toshiba Chemical Co., Ltd.) and evaluated according to the following criteria.

[Evaluation Criteria]

A: 30 (−μc/g)<Charge amount

B: 20 (−μc/g)≤Charge amount ≤30 (−μc/g)

C: Charge amount<20 (−μc/g)

TABLE 4

| | Toner | | | | | | | |
|---|---|---|---|---|---|---|---|---|
| | | External additive | | | | | | |
| | Dv/Dn | NSP* | SP* | Ti oxide | Coverage rate Ca (%) | Coverage rate 3Ca (%) | Coverage rate Cb (%) | 3Ca (%) < Cb (%) |
| Ex. 1 | 1.2 | NSP A | SP A | Used | 14 | 42 | 61 | Satisfied |
| Ex. 2 | 1.2 | NSP B | SP B | Used | 19 | 57 | 60 | Satisfied |
| Ex. 3 | 1.2 | NSP C | SP C | Used | 12 | 36 | 50 | Satisfied |
| Ex. 4 | 1.2 | NSP D | SP A | Used | 13 | 39 | 46 | Satisfied |
| Ex. 5 | 1.2 | NSP E | SP A | Used | 13 | 39 | 68 | Satisfied |
| Ex. 6 | 1.1 | NSP F | SP B | Used | 14 | 42 | 55 | Satisfied |
| Ex. 7 | 1.1 | NSP G | SP B | Used | 14 | 42 | 55 | Satisfied |
| Ex. 8 | 1.1 | NSP H | SP C | Used | 14 | 42 | 50 | Satisfied |
| Ex. 9 | 1.1 | NSP I | SP C | Used | 14 | 42 | 50 | Satisfied |
| Ex. 10 | 1.3 | NSP A | SP A | Used | 14 | 42 | 61 | Satisfied |
| Ex. 11 | 1.2 | NSP A | SP A | Not used | 14 | 42 | 61 | Satisfied |
| Ex. 12 | 1.2 | NSP A | SP F | Used | 14 | 42 | 61 | Satisfied |
| Ex. 13 | 1.2 | NSP Q | SP A | Used | 14 | 42 | 61 | Satisfied |
| Ex. 14 | 1.2 | NSP R | SP A | Used | 14 | 42 | 61 | Satisfied |
| Ex. 15 | 1.2 | NSP J | SP A | Used | 15 | 45 | 61 | Satisfied |
| Ex. 16 | 1.2 | NSP K | SP A | Used | 16 | 48 | 61 | Satisfied |
| Ex. 17 | 1.2 | NSP L | SP B | Used | 12 | 36 | 55 | Satisfied |
| Ex. 18 | 1.2 | NSP M | SP B | Used | 11 | 33 | 55 | Satisfied |
| Ex. 19 | 1.1 | NSP A | SP D | Used | 14 | 42 | 61 | Satisfied |
| Ex. 20 | 1.1 | NSP O | SP A | Used | 14 | 42 | 61 | Satisfied |

TABLE 4-continued

| | Toner | | | | | | | |
|---|---|---|---|---|---|---|---|---|
| | | External additive | | | | | | |
| | Dv/Dn | NSP* | SP* | Ti oxide | Coverage rate Ca (%) | Coverage rate 3Ca (%) | Coverage rate Cb (%) | 3Ca (%) < Cb (%) |
| Comp. Ex. 1 | 1.2 | NSP A | SP C | Used | 15 | 45 | 45 | Not satisfied |
| Comp. Ex. 2 | 1.1 | NSP A | SP C | Used | 17 | 51 | 45 | Not satisfied |
| Comp. Ex. 3 | 1.1 | NSP A | SP P | Used | 14 | 42 | 61 | Satisfied |
| Comp. Ex. 4 | 1.1 | NSP A | SP A | Used | 8 | 24 | 61 | Satisfied |
| Comp. Ex. 5 | 1.1 | NSP A | SP A | Used | 22 | 66 | 68 | Satisfied |
| Comp. Ex. 6 | 1.1 | NSP C | SP B | Used | 12 | 36 | 38 | Satisfied |
| Comp. Ex. 7 | 1.1 | NSP A | SP A | Used | 14 | 42 | 73 | Satisfied |

*"NSP" and "SP" mean "non-spherical particles" and "spherical particles," respectively.

TABLE 5

| | Evaluation | | | | |
|---|---|---|---|---|---|
| | Heat resistance storageability | Transfer-ability | Flow-ability | Filming property | Charge-ability |
| Ex. 1 | B | A | A | A | B |
| Ex. 2 | B | A | B | A | A |
| Ex. 3 | B | A | A | A | A |
| Ex. 4 | A | A | A | A | B |
| Ex. 5 | A | A | A | A | B |
| Ex. 6 | B | B | B | B | B |
| Ex. 7 | B | A | B | B | B |
| Ex. 8 | B | B | A | B | B |
| Ex. 9 | B | A | A | B | B |
| Ex. 10 | B | B | B | B | B |
| Ex. 11 | B | B | B | A | B |
| Ex. 12 | B | B | A | A | A |
| Ex. 13 | B | B | B | A | A |
| Ex. 14 | A | A | B | B | B |
| Ex. 15 | C | B | B | B | A |
| Ex. 16 | B | C | B | B | A |
| Ex. 17 | B | C | B | B | A |
| Ex. 18 | C | C | C | C | B |
| Ex. 19 | C | B | C | C | B |
| Ex. 20 | B | C | A | C | B |
| Comp. Ex. 1 | D | D | D | D | A |
| Comp. Ex. 2 | D | B | B | C | A |
| Comp. Ex. 3 | D | B | D | D | C |
| Comp. Ex. 4 | D | D | D | B | A |
| Comp. Ex. 5 | A | A | B | D | C |
| Comp. Ex. 6 | D | D | D | A | C |
| Comp. Ex. 7 | A | B | A | D | A |

As is clear from the results obtained, the toner of the present invention is satisfactory in all of heat resistance storageability, transferability, flowability, filming property and chargeability as well as is excellent in image quality with preventing formation of abnormal image due to degradation of the toner.

Aspects of the present invention are as follows, for example.

<1> A toner including:

toner base particles; and an external additive, the toner base particles each including a binder resin and a colorant, wherein the external additive includes non-spherical particles and spherical particles, wherein the non-spherical particles are each a secondary particle in which spherical primary particles are coalesced together, and wherein the non-spherical particles and the spherical particles in the external additive satisfy a relationship expressed by the following formula (1):

$$3Ca(\%)<Cb(\%) \qquad \text{Formula (1)}$$

where Ca is greater than 10% but smaller than 20% and Cb is greater than 40% but smaller than 70%, and Ca and Cb are values given by:

$$Ca = \frac{\begin{array}{c}(\text{an amount of the non-spherical particles (\% by mass)}/100)\times \\ (\text{a projected area of the non-spherical particles (cm}^2\text{/g))}\end{array}}{\begin{array}{c}(\text{an amount of the toner base particles (\% by mass)}/100)\times \\ (\text{a surface area of the toner base particles (cm}^2\text{/g))}\end{array}}\times 100$$

$$Cb = \frac{\begin{array}{c}(\text{an amount of the spherical particles (\% by mass)}/100)\times \\ (\text{a projected area of the spherical particles (cm}^2\text{/g))}\end{array}}{\begin{array}{c}(\text{an amount of the toner base particles (\% by mass)}/100)\times \\ (\text{a surface area of the toner base particles (cm}^2\text{/g))}\end{array}}\times 100$$

where the surface area of the toner base particles is a value given by: 6/(an average particle diameter of the toner×a specific gravity of the toner);

the projected area of the non-spherical particles is a value given by: 3/(2×an average particle diameter of the non-spherical particles×a specific gravity of the non-spherical particles); and the projected area of the spherical particles is a value given by: 3/(2×an average particle diameter of the spherical particles×a specific gravity of the spherical particles).

<2> The toner according to <1>, wherein the non-spherical particles have an average of degrees of coalescence of 1.7 to 4.0, each of the degrees of coalescence being given by: a particle diameter of the secondary particle/an average particle diameter of the primary particles.

<3> The toner according to <1> or <2>, wherein the non-spherical particles contain sol-gel silica, and wherein the non-spherical particles have an average particle diameter of 60 nm to 480 nm.

<4> The toner according to <3>, wherein an amount of carbon remaining in the sol-gel silica and derived from an alkoxy group is 1% by mass or less.

<5> The toner according to <3>, wherein an amount of water remaining in the sol-gel silica is 1% by mass or less.

<6> The toner according to any one of <1> to <5>, wherein the spherical particles contain dry silica, and wherein the spherical particles have an average particle diameter of 10 nm to 35 nm.

<7> The toner according to any one of <1> to <6>, wherein the spherical particles further contain titanium oxide.

<8> The toner according to any one of <1> to <7>, wherein the toner has a ratio Dv/Dn of 1.0 to 1.2 where Dv is a volume average particle diameter of the toner and Dn is a number average particle diameter.

<9> A two-component developer including:

the toner according to any one of <1> to <8>; and a carrier.

<10> An image forming apparatus including:

a latent electrostatic image bearing member;

a latent electrostatic image forming unit configured to form a latent electrostatic image on the latent electrostatic image bearing member;

a developing unit configured to develop the latent electrostatic image with the toner according to any one of <1> to <8>, to thereby form a visible image;

a transfer unit configured to transfer the visible image onto a recording medium; and a fixing unit configured to fix the visible image transferred on the recording medium.

This application claims priority to Japanese application No. 2012-057367, filed on Mar. 14, 2012 and incorporated herein by reference.

What is claimed is:

1. A toner comprising:

toner base particles; and an external additive, the toner base particles each comprising a binder resin and a colorant, wherein the external additive comprises non-spherical particles and spherical particles, wherein the spherical particles comprise dry silica, and have an average particle diameter of 10 nm to 35 nm, wherein the non-spherical particles comprise sol-gel silica and are each a secondary particle in which spherical primary particles are coalesced together, wherein the non-spherical particles have an average particle diameter of 60 nm to 480 nm, and wherein the non-spherical particles and the spherical particles in the external additive satisfy a relationship expressed by the following formula (1):

$$3Ca(\%)<Cb(\%) \qquad \text{Formula (1)}$$

where Ca is greater than 10% but smaller than 20% and Cb is greater than 40% but smaller than 70%, and Ca and Cb are values given by:

$$Ca = \frac{\begin{array}{c}(\text{an amount of the non-spherical particles (\% by mass)}/100)\times\\(\text{a projected area of the non-spherical particles (cm}^2\text{/g)})\end{array}}{\begin{array}{c}(\text{an amount of the toner base particles (\% by mass)}/100)\times\\(\text{a surface area of the toner base particles (cm}^2\text{/g)})\end{array}}\times 100$$

$$Cb = \frac{\begin{array}{c}(\text{an amount of the spherical particles (\% by mass)}/100)\times\\(\text{a projected area of the spherical particles (cm}^2\text{/g)})\end{array}}{\begin{array}{c}(\text{an amount of the toner base particles (\% by mass)}/100)\times\\(\text{a surface area of the toner base particles (cm}^2\text{/g)})\end{array}}\times 100$$

where the surface area of the toner base particles is a value given by: 6/(an average particle diameter of the toner x a specific gravity of the toner);

the projected area of the non-spherical particles is a value given by: 3/(2×an average particle diameter of the non-spherical particles x a specific gravity of the non-spherical particles); and the projected area of the spherical particles is a value given by: 3/(2×an average particle diameter of the spherical particles x a specific gravity of the spherical particles).

2. The toner according to claim 1, wherein the non-spherical particles have an average of degrees of coalescence of 1.7to 4.0, each of the degrees of coalescence being given by: a particle diameter of the secondary particle/an average particle diameter of the primary particles.

3. The toner according to claim 1, wherein an amount of carbon remaining in the sol-gel silica and derived from an alkoxy group is 1% by mass or less.

4. The toner according to claim 1, wherein an amount of water remaining in the sol-gel silica is 1% by mass or less.

5. The toner according to claim 1, wherein the spherical particles further comprise titanium oxide.

6. The toner according to claim 1, wherein the toner has a ratio Dv/Dn of 1.0 to 1.2 where Dv is a volume average particle diameter of the toner and Dn is a number average particle diameter.

7. A two-component developer comprising:

the toner according to claim 1; and a carrier.

* * * * *